US006921093B2

(12) United States Patent
Svensson et al.

(10) Patent No.: US 6,921,093 B2
(45) Date of Patent: Jul. 26, 2005

(54) FLEXING BASE SKATE

(75) Inventors: John E. Svensson, Vashon, WA (US); Antonin A. Meibock, Calgary (CA)

(73) Assignee: K-2 Corporation, Vashon, WA (US)

( * ) Notice: Subject to any disclaimer, the term of this patent is extended or adjusted under 35 U.S.C. 154(b) by 22 days.

(21) Appl. No.: 10/743,428

(22) Filed: Dec. 22, 2003

(65) Prior Publication Data

US 2004/0135328 A1 Jul. 15, 2004

Related U.S. Application Data

(63) Continuation of application No. 10/188,737, filed on Jul. 2, 2002, now Pat. No. 6,666,463, which is a continuation of application No. 09/632,453, filed on Aug. 4, 2000, now abandoned, which is a continuation-in-part of application No. 09/094,425, filed on Jun. 9, 1998, now Pat. No. 6,120,040, which is a continuation-in-part of application No. 08/957,436, filed on Oct. 24, 1997, now Pat. No. 6,082,744.

(51) Int. Cl.[7] ..... A63C 17/04

(52) U.S. Cl. ..... 280/11.224; 280/11.231

(58) Field of Search ..... 280/11.19, 11.221, 280/11.224, 11.225, 11.231, 11.27, 11.28, 11.15; 36/115

(56) References Cited

U.S. PATENT DOCUMENTS

| | | |
|---|---|---|
| 36,244 A | 8/1862 | Starr |
| 63,946 A | 4/1867 | Sanford |

(Continued)

FOREIGN PATENT DOCUMENTS

| | | |
|---|---|---|
| DE | 78 733 | 1/1894 |
| DE | 484 530 | 10/1929 |
| DE | 488 768 | 12/1929 |
| DE | 488 740 | 1/1930 |
| DE | 811 095 | 8/1951 |
| DE | 25 27 611 A1 | 12/1976 |
| DE | 35 42 251 A1 | 6/1987 |
| EP | 0 192 312 A2 | 8/1986 |
| EP | 0 551 704 A2 | 7/1993 |
| EP | 0 568 878 A1 | 11/1993 |
| EP | 0 599 043 B1 | 6/1994 |
| EP | 0 599 043 A2 | 6/1994 |
| EP | 0 774 282 A1 | 5/1997 |
| EP | 0 778 058 A2 | 6/1997 |
| EP | 0 568 878 B1 | 2/1998 |
| EP | 0 799 629 B1 | 12/1999 |
| EP | 0 778 058 B1 | 3/2001 |
| FR | 2 642 980 A1 | 8/1990 |
| FR | 2 659 534 A1 | 9/1991 |
| FR | 2 672 812 A1 | 8/1992 |
| FR | 2 749 183 A1 | 12/1997 |
| GB | 505349 | 5/1939 |
| NL | 8 702 068 | 4/1989 |
| WO | WO 92/09340 A1 | 6/1992 |
| WO | WO 92/11908 A1 | 7/1992 |
| WO | WO 96/37269 A1 | 11/1996 |
| WO | WO 97/32637 A1 | 9/1997 |
| WO | WO 97/36655 A1 | 10/1997 |
| WO | WO 98/47576 A1 | 10/1998 |

*Primary Examiner*—Bryan Fischmann
(74) *Attorney, Agent, or Firm*—Christensen, O'Connor, Johnson, Kindness, PLLC

(57) ABSTRACT

A flexing base skate (100) includes an upper shoe portion (12) mounted on a base (14). The base includes a forefoot region (20) secured to a forward frame segment (26) carrying forward wheels (18*a*, 18*b*). A heel region of the base is secured to a rearward frame segment (28) that carries rearward wheels (18*c*, 18*d*). A second embodiment (100) provides a rigid full length frame (112) and a base (104) mounted at the forefoot region (106) to the frame. The base flexes at a metatarsal portion (108), and forms an integral spring biasing the base against the frame. The base includes a guide (118) for lateral alignment of the heel region with the frame. Another embodiment (210) provides a forward frame segment (226) carrying forward wheels (218) and a rearward frame segment (228) carrying rearward wheel (218).

19 Claims, 17 Drawing Sheets

U.S. PATENT DOCUMENTS 601,013 A 3/1898 Evans
609,401 A 8/1898 Beisel
1,228,544 A 6/1917 Falstrem et al.
1,603,588 A 10/1926 Eberle
1,702,316 A 2/1929 Ridgers
1,751,692 A 3/1930 Frühbeis
1,789,182 A 1/1931 Klevstad
2,093,915 A 9/1937 Klevstad
2,120,987 A 6/1938 Murray
2,987,834 A 6/1961 Howe
3,114,562 A 12/1963 Goodman
3,749,413 A 7/1973 Nicolson
3,900,203 A 8/1975 Kukulowicz
3,936,061 A 2/1976 Wada
4,061,348 A 12/1977 Carter
4,107,856 A 8/1978 Bourque
4,108,450 A 8/1978 Coté
4,126,323 A 11/1978 Scherz
4,272,090 A 6/1981 Wheat
4,470,205 A 9/1984 Olivieri
4,839,972 A 6/1989 Pack et al.
5,014,450 A 5/1991 McGrath
5,184,834 A 2/1993 Yu
5,228,705 A 7/1993 Merle-Smith
5,257,793 A 11/1993 Fortin
5,342,071 A 8/1994 Soo
5,397,141 A 3/1995 Hoshizaki et al.
5,435,579 A 7/1995 Pozzobon
5,484,149 A 1/1996 Lee
5,498,009 A 3/1996 Young
5,503,413 A 4/1996 Belogour
5,505,467 A 4/1996 Hill et al.
5,586,774 A 12/1996 Dentale
5,634,648 A 6/1997 Tonel et al.
5,690,344 A 11/1997 Chen
5,704,620 A 1/1998 Oliemans et al.
5,797,608 A 8/1998 Heldemann
5,842,706 A 12/1998 Chang
5,890,724 A 4/1999 Gignoux et al.
5,904,359 A 5/1999 Caeran et al.
5,904,360 A 5/1999 Oliemans et al.
5,951,027 A 9/1999 Oyen et al.
5,957,470 A 9/1999 Powell
5,979,916 A 11/1999 Gatel et al.
6,007,075 A 12/1999 Shum
6,120,040 A 9/2000 Svensson et al.
6,325,394 B1 12/2001 Svensson et al.

FLEXING BASE SKATE

CROSS-REFERENCES TO RELATED APPLICATIONS

This application is a continuation of U.S. patent application Ser. No. 10/188,737, filed Jul. 2, 2002 now U.S. Pat. No. 6,666,463, which is a continuation of U.S. patent application Ser. No. 09/632,453, filed Aug. 4, 2000, now abandoned, which is continuation-in-part of U.S. patent application Ser. No. 09/094,425, filed Jun. 9, 1998, now U.S. Pat. No. 6,120,040, which is a continuation-in-part of U.S. patent application Ser. No. 08/957,436, filed Oct. 24, 1997, now U.S. Pat. No. 6,082,744, priority of the filing date of which is hereby claimed under 35 U.S.C. § 120.

FIELD OF THE INVENTION

The present invention relates to roller skates and, more particularly, to in-line roller skates with flexible bases.

BACKGROUND OF THE INVENTION

Conventional in-line roller skates include an upper boot secured to or integrally formed with a rigid or semirigid base. The base, in turn, is secured along its length, including at heel and toe ends, to a rigid frame. A plurality of wheels is journaled along a common longitudinal axis between the sidewalls of the frame. During use, the skater alternatingly strokes on the left and right skates, thrusting off of one skate while gliding on the opposing skate. The ability to fully complete a thrust and thereby achieve maximum forward momentum is limited, however, because of the rigid frame being secured to the heel and toe of the skater's foot.

Because of the rigid, inflexible securement of the frame and base of such skates, a skater attempting to achieve optimal speed during skating may adopt a skating stroke that does not entail plantarflexing of his or her ankle during the push-off phase of the stroke. The term "plantarflex" refers to the rotation of the foot relative to the leg within a plane defined by the leg, where the forefoot moves distally relative to the leg. By avoiding plantarflexion at the ankle, all skate wheels remain on the ground, with the skate base and frame parallel to the ground. The skate thus does not pivot significantly on the forward-most wheel. Alternately, a skater may adopt a stroke style entailing plantarflexion of his or her ankle during the skate stroke, allowing the forefoot to move distally of the leg, thereby allowing the calf muscles to generate more power during the skate stroke. Due to the rigid nature of the frame and base however, this causes the skater's ankle to elevate excessively off the ground, and may be uncomfortable for the skater. This also entails excessive movement of the skater's upper body and legs, and excess wear of the front wheel.

In-line skates with wheels supported on first and second separate frame sections, secured beneath the toe and heel of the skate such that the foot can flex during the skating stroke, have been proposed. For example, U.S. Pat. No. 5,634,648 discloses a skate including a boot having a rigid toe portion pivotally coupled at the lateral sides of the foot to a rigid heel portion. A first frame segment supporting two wheels is secured beneath the toe section and a second frame segment supporting two additional wheels is secured beneath the heel section. A tab extends rearwardly from the base of the toe section and is received within a corresponding slot formed in the base of the heel section. During use, the skater is able to flex the foot at the sidewall pivot point of the upper, with the tab flexing along its length, so that the heel and rear frame section can elevate off of the ground. While permitting flexion of the foot, flexion is not centralized or primarily occurring at the metatarsal head of the skater's foot, as is anatomically preferred. Thus flexing may be uncomfortable. Additionally, because the boot flexes rearwardly of the front frame and wheels, an unstable platform is provided by the forward segment of the frame during thrusting with the heel elevated. Further, because the two frame segments are separated and uncoupled at all times there is no lateral rigidity of the frame, even when both frame sections are on the ground. Thus, except to the limited extent provided by the pivot joints between the heel and toe sections of the upper and the forward to rearward tab, there is no torsional rigidity of the skate, as would be desired for straight tracking of the skate.

An alternate flexing skate has been proposed in European Patent Application No. EP 0 778 058 A2. A skate is disclosed having an upper boot with a separate toe segment that is slidably received within the forward end of a rear boot segment and which is pivotally joined to the rear boot segment immediately below the base of the skate. Forward and rearward frame sections are secured beneath the forward and rearward segments of the boot. The rear ends of the sidewalls of the forward frame section overlap the forward ends of the sidewalls of the rear frame section. A second pivot pin is secured through aligned apertures in the forward frame section sidewalls and through corresponding slots in the overlapped sidewalls of the rear frame section. During use, the boot pivots to allow the foot to flex during thrusting, with the slotted rearward frame section moving on the second pivot pin retained by the forward frame section. Thus, a limited degree of flexure is provided, with the pivotal coupling of the frame segments also providing a degree of lateral stability and torsional stiffness.

The degree of flexion of such a skate disclosed in the European '058 application is limited, however, by the relatively short length of the slots formed in the rearward frame section. Further, the upper or lower positioning of the rear end of the skate is controlled solely by force applied by the user's foot and leg. During the portion of the skating stroke where the user would desire the wheels to be commonly aligned on the ground in a flat line, the rear of the skate may thus undesirably bump upwardly and downwardly. An alternate embodiment of a skate disclosed in the same European '058 application has a rigid full-length frame and an unsecured rear boot portion which can be lifted off of the frame for flexure during the stroke. However, there is no provision for laterally stabilizing the heel of the boot relative to the frame, such that undesired torsional or lateral movement of the boot relative to the frame may be encountered. Additionally, as in the segmented frame embodiment, the heel may lift undesirably from the frame at inappropriate times.

SUMMARY OF THE INVENTION

The present invention provides a roller skate having a shoe portion for receiving a skater's foot and a base having an upper surface securable to an underside of the shoe portion for supporting the received skater's foot. The base includes a heel region and a forefoot region, the forefoot region having a metatarsal head portion. A frame is secured to an underside of the base at least below the forefoot region of the base such that the base can flex intermediate of the forefoot region and heel region during skating to permit elevation of the skater's heel. The frame extends below the base and rotatably receives a plurality of wheels. At least one forward wheel is disposed below the forefoot region of the base, and at least one rearward wheel is disposed below the heel region of the base. The metatarsal head portion of the base defines a stress-concentrating contour that focuses flexure of the base at the metatarsal head portion.

In a further aspect of the present invention, the skate includes a biasing member coupled to the base to bias the heel region of the base to a lower position, in which the heel region of the base bears on the frame, the rearward wheel, and the ground. The biasing member preferably exerts a downward preload on the heel region of the base when the heel region is in the lower position.

In a first preferred embodiment of the present invention, the frame of the skate includes a forward segment secured to an underside of the base below the forefoot region of the base, and a rearward segment secured to the underside of the base below the heel region. The forward segment mounts the at least one forward wheel below the forefoot region of the base, while the rearward segment mounts the at least one rearward wheel below the heel region of the base. One of the forward or rearward frame segments includes first and second stabilizing flanges that extend toward and slidably overlap opposing first and second sides of the other of the forward and rearward frame segments. The forward and rearward frame segments freely slide and pivot relative to each other during flexure of the base.

In a second preferred embodiment of the present invention, the frame of the skate includes a forward segment that mounts at least two forward wheels below the forefoot region of the base, and a rearward segment that mounts at least one rearward wheel below the heel region of the base, wherein the forward segment includes first and second stabilizing flanges that extend toward and slidably overlap or underlap the rearward frame segment, such that the at least two wheels will be in contact with the skating surface during the skater's power stroke and the forward and rearward frame segments remain longitudinally stable during flexure over the complete stroke.

In an alternate preferred embodiment to the present invention, the skate includes a frame secured to an underside of the base at the forefoot region of the base. The heel region of the base bears on the frame in a lower position and elevates away from the frame to an upper position upon flexure of the base during skating. A guide is secured to one of the frames and the heel region of the base and projects toward and slidably engages the other of the frame and the heel region of the base during flexure of the base.

The present invention thus provides skates having bases that flex, preferably below the metatarsal head of the skater's foot, in conformity with the anatomy of the foot. In a first preferred embodiment, the frame is split into two segments that overlap each other for lateral stability, yet which freely and slidably pivot relative to each other during flexure. In an alternate embodiment, the heel of the shoe portion lifts away from the frame during flexure, and a guide is preferably provided that maintains lateral positioning of the upper relative to the frame during this movement. Thus the skates of the present invention provide for increased thrust during the skating stroke due to the ability to flex the foot, and concentrate flexing at the foot at the point most anatomically desirable and efficient. The preferred embodiments of the present invention include a biasing member, such as a spring plate, that preloads the heel of the skate in the lower position, such that after each stroke during skating, the heels snap back downwardly for full engagement with the frame and ground.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 13 provides an isometric view of the forward and rearward frame segments of the skate of FIG. 10;

DETAILED DESCRIPTION OF THE PREFERRED EMBODIMENT

Figure 1:
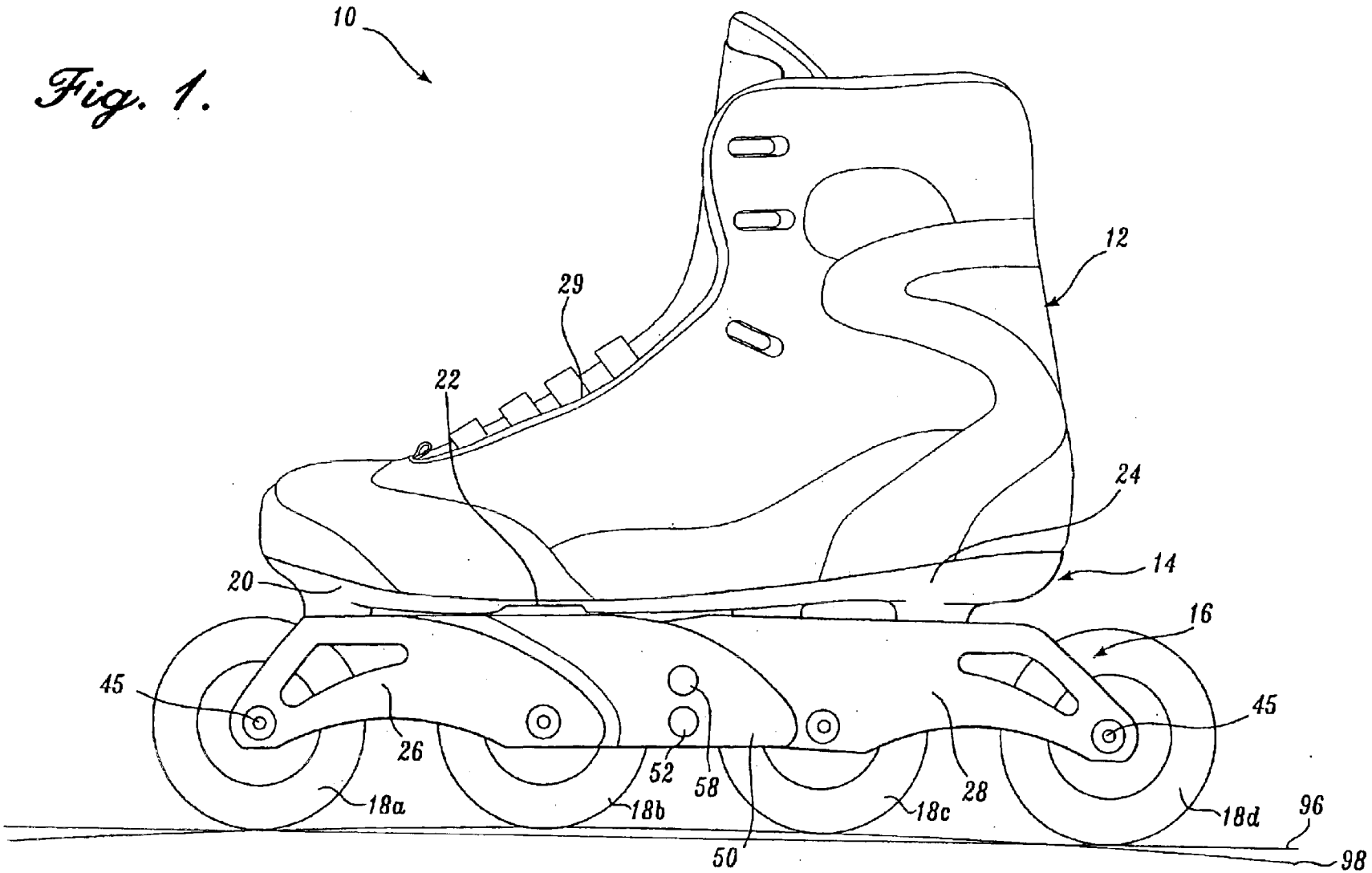
FIG. 1 provides a side view of a skate constructed in accordance with a first preferred embodiment of the present invention, having a flexing base and split frame, with the skate illustrated in the nonflexed and nonloaded configuration.
Figure 2:
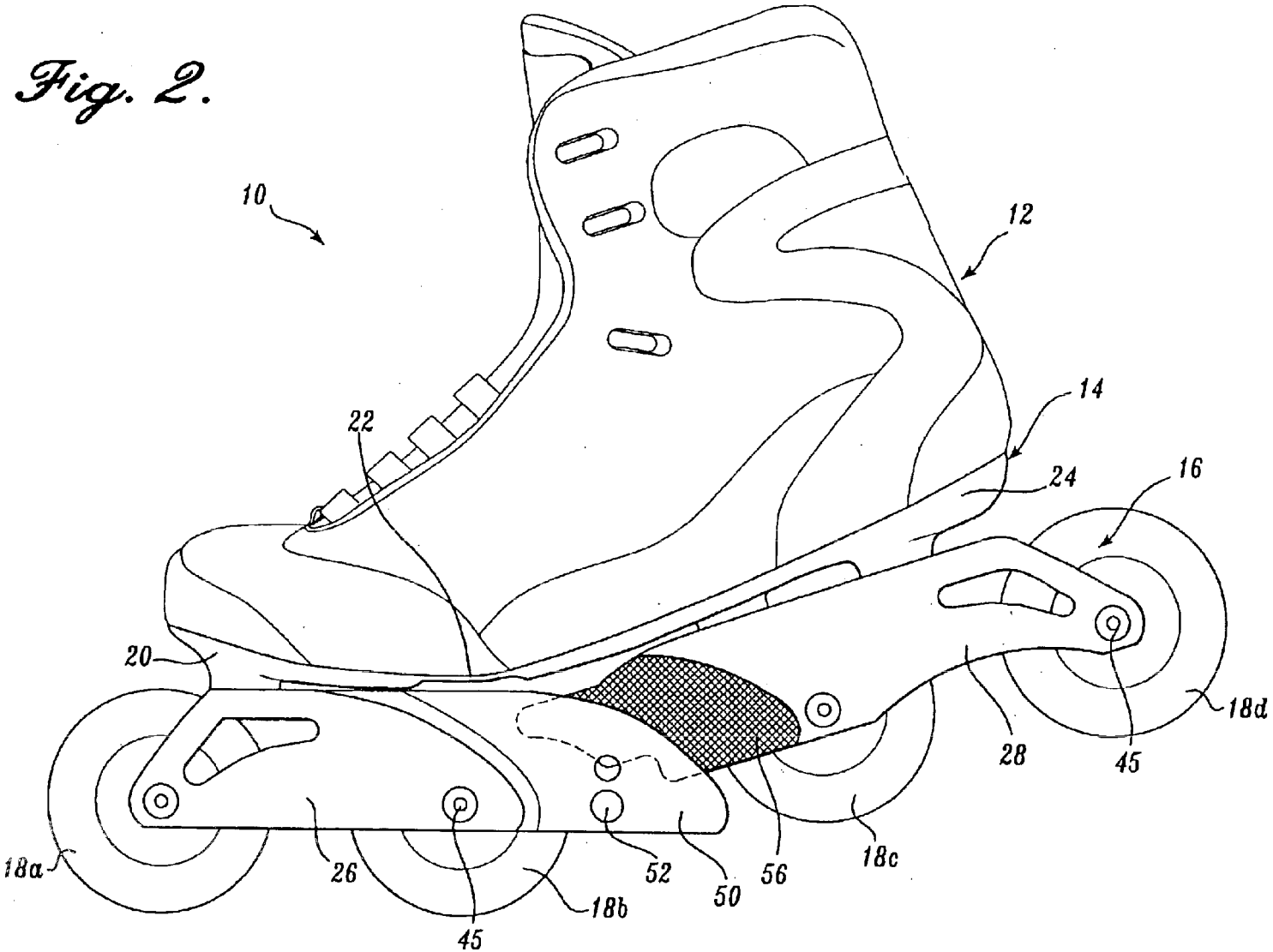
FIG. 2 provides a side view of the skate of FIG. 1 with the skate in the flexed configuration.

A first preferred embodiment of a flexing base skate 10 constructed in accordance with the present invention is illustrated in FIGS. 1 and 2. The skate 10 includes an upper shoe portion 12 that receives and surrounds a skater's foot and ankle, and which is mounted on and secured to a base 14 that is flexible at least at one point along its length. The base 14 underlies and supports the user's foot. The base 14 is in turn secured to a split frame assembly 16 extending longitudinally beneath the base 14. A plurality of wheels 18*a*, 18*b*, 18*c*, and 18*d* are journaled between first and second opposing longitudinal sidewalls of the frame assembly 16.

The base 14 includes a forefoot region 20 that underlies and supports the ball and toes of the user's foot. The forefoot region 20 of the base includes a metatarsal head portion 22 that underlies the zone corresponding to the metatarsal head of a skater's foot. The base 14 extends rearwardly, terminating in a heel region 24 underlying the skater's heel. The frame assembly 16 includes a forward frame segment 26 secured to the forefoot region 20 of the base 14, and a rearward frame segment 28 that is secured to the heel region 24 of the base 14. As used herein throughout, "forward" refers to the direction of the forefoot region 20 of the skate, while the term "rearward" refers to the opposing direction of the heel region 24 of the skate.

The inclusion of a forward frame segment 26 and a rearward frame segment 28, and the formation of the base 14 to permit flexure intermediate of the forward and rearward ends of the base 14, permit the skater's foot and the upper shoe portion 12 to flex during the skating stroke. The base 14 and upper shoe portion 12 flex from a lower position, illustrated in FIG. 1, in which the front and rear frame segments 26, 28 are longitudinally aligned, and a flexed, upper position illustrated in FIG. 2, in which the heel region 24 of the base 14 and rearward frame segment 28 pivot upwardly relative to the forefoot region 20 of the base 14 and forward frame segment 26. Each of the components of the skate 10 will now be described in greater detail.

Referring to FIGS. 1 and 2, the upper shoe portion 12 is of conventional construction, surrounding the toes, sides, heels, and ankle of a user's foot. The upper shoe portion 12 includes a vamp 29, a tongue, and a closure, such as a lace system. The upper shoe portion 12 illustrated is supported by a rigid or semirigid internal heel cup and ankle cuff (not shown), which helps vertically stabilize the skate. Other conventional upper shoe portion constructions are also within the scope of the present invention, including flexible uppers reinforced by external ankle cuffs and heel cups. The upper shoe portion 12 is constructed at least partially from flexible materials so that the upper shoe portion 12 will flex together with the base 14.

Figure 3:
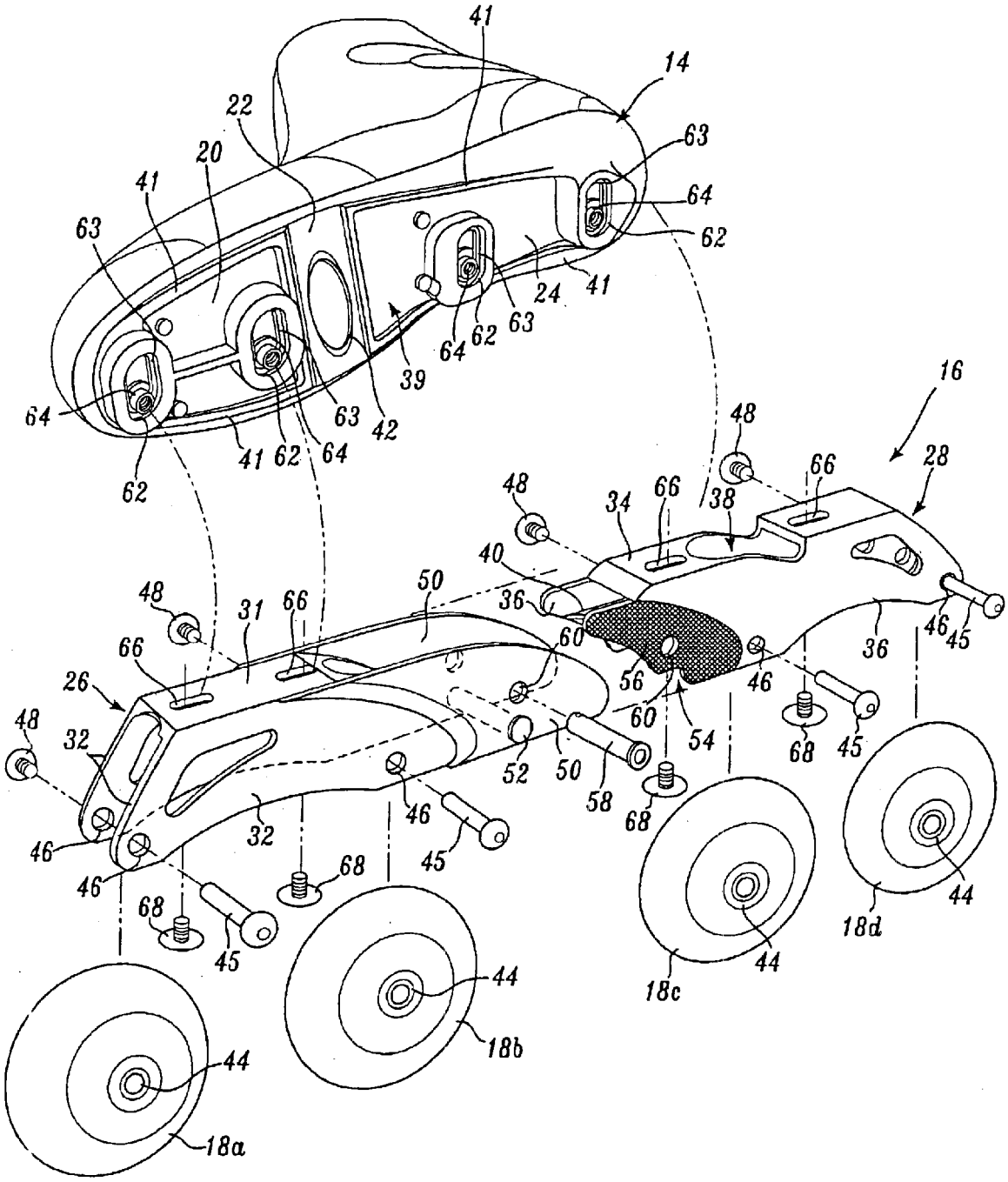
FIG. 3 provides an exploded pictorial view of the skate of FIG. 1.
Figure 4:
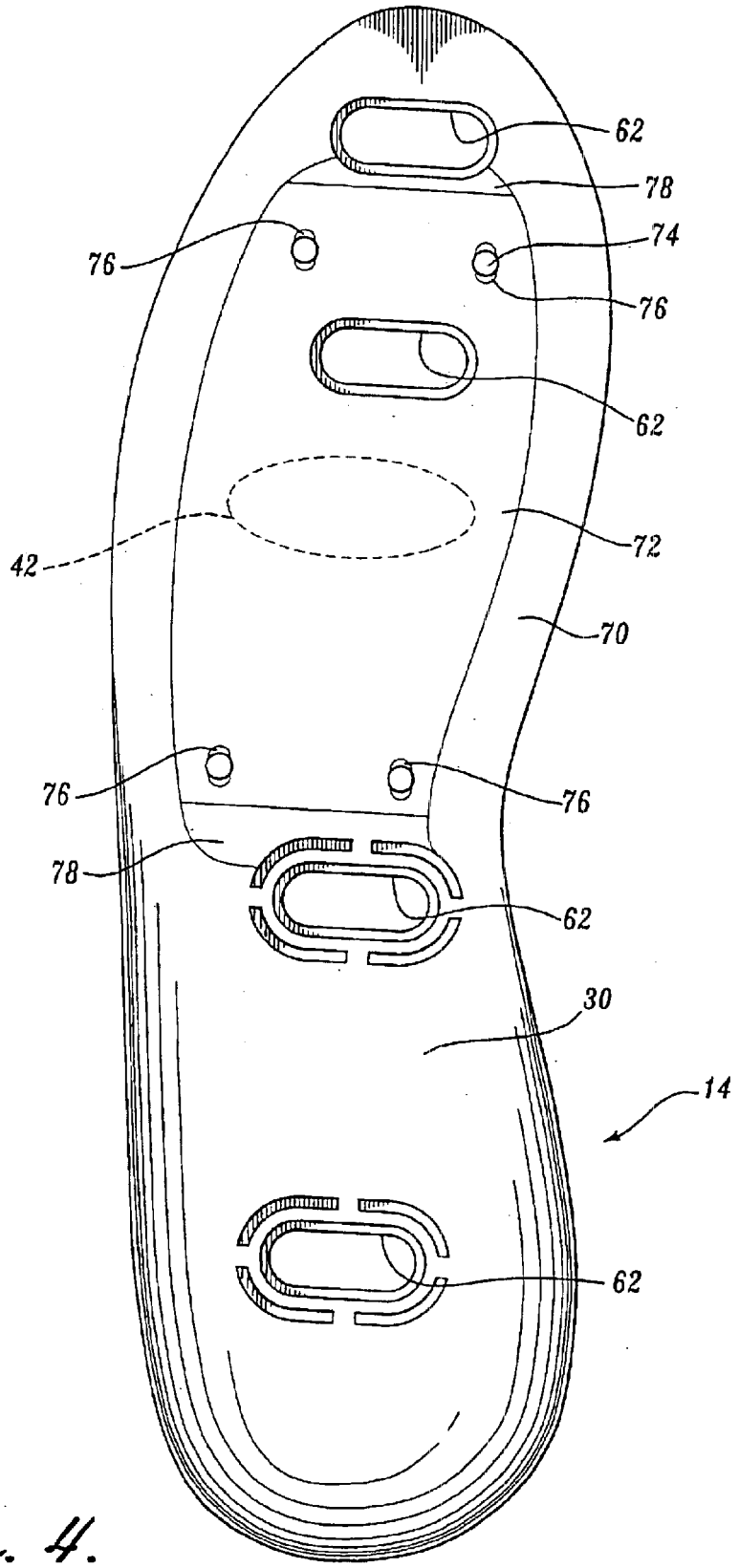
FIG. 4 provides a top plan view of the base of the skate of FIG. 1.

The base 14 is best viewed in FIGS. 1, 3, and 4. The base 14 has an upper surface 30 (FIG. 4) that receives and supports the undersides of the upper shoe portion 12. The base 14 is secured to the upper shoe portion 12 by any conventional method, including bolting, riveting, stitching, and adhesive lasting. While the base 14 is illustrated as separate from the upper shoe portion 12, it should also be understood that the base 14 could be integrally formed with the upper shoe portion 12, so long as the upper shoe portion 12 and base 14 accommodate flexing in the manner to be described further herein. The upper surface 30 of the base 14 is bordered by a raised lip surrounding the perimeter of the base 14. The lip extends upwardly at the rear and forward ends to partially surround the lower edges of the toes and heels of the user.

As best illustrated in FIGS. 1 and 3, the base 14 includes a lower surface 39 that is supported by longitudinally oriented ribs 41 extending along the inner and outer longitudinal sides of the lower surface 39 of the base 14. The ribs 41, formed as increased thickness sections of the base 14, serve to rigidize the heel region 24 and a forward portion of the forefoot region 20 of the base 14. However, the ribs 41 do not extend longitudinally below the metatarsal head portion 22 of the forefoot region 20 of the base. Thus, the effective thickness of the metatarsal portion 22 of the base 14 is reduced relative to the thickness of the surrounding regions of the base 14. This reduced thickness enables the base 14 to flex at the metatarsal head portion 22 and, more specifically, focuses the flexure of the base 14 at the metatarsal head portion 22, in a gradual arc along the length of the metatarsal head portion, as illustrated in FIG. 2.

The ability of the metatarsal head portion 22 to flex is further enhanced by the formation of a transverse, elongate aperture 42 through the metatarsal head portion 22. The aperture 42 extends transversally and centrally across approximately half of the width of the metatarsal head portion 22, and also extends forwardly and rearwardly across the majority of the length of the metatarsal head portion 22. This aperture 42 serves to further concentrate the stress of flexure on the metatarsal head portion 22. Moreover, the aperture 42 is formed with a transverse elongate ovoid configuration, serving to further focus the flexure along the centerline of the metatarsal head portion 22. Thus, as illustrated in FIG. 2, the base 14 and upper shoe portion 12 flex at the anatomically preferred position just below the metatarsal head, following the natural contour of the metatarsal head as it flexes.

Attention is now directed to FIG. 3 to describe the construction of the split frame assembly 16. Each of the forward frame segment 26 and the rearward frame segment 28 has an independent torsion box construction. The forward frame segment 26 has a top wall 31 extending rearwardly from immediately below a forward toe portion of the forefoot region 20 of the base 14, to just forwardly of the metatarsal head portion 22. The forward frame segment 26 further includes left and right opposing sidewalls 32 that are oriented longitudinally relative to the length of the base 14. The rear frame segment 28 correspondingly includes a top wall 34 and longitudinal left and right sidewalls 36. The top wall 34 runs from beneath an arch portion of the heel region 24 of the base 14, to the rear end of the heel region 24. A weight-reducing aperture 38 is cut out from the center of the top wall 34.

The top walls 31 and 34 of the forward and rearward frame segments 26 and 28 are horizontally oriented, with the sidewalls 32 and 36 projecting perpendicularly downward therefrom. Each frame segment 26, 28 is completed by a series of lower horizontal braces 40 spanning between the left and right sidewalls 32 of the forward frame segment 26 and the left and right sidewalls 36 of the rearward frame segment 28. The lower braces are parallel to and spaced downwardly from the top walls 31 and 34, and are oriented between the wheels 18*a*, 18*b*, 18*c*, and 18*d*.

Specifically, the forward frame segment 26 carries a first forward wheel 18*a* and a second forward wheel 18*b* journaled between the opposing sidewalls 32. Each wheel includes a center hub and bearing assembly 44 that is mounted rotatably on an axle 45 that is inserted through aligned apertures 46 of the sidewalls 32 and are retained by cap screws 48. In the forward segment 26 of the frame, a single horizontal brace 40 is disposed between the first forward wheel 18*a* and the second forward wheel 18*b*. The rearward frame segment 28 similarly carries a first rearward wheel 18*c* and a second rearward wheel 18*d* journaled between its sidewalls 36 on axles 45. A first horizontal brace 40 (not shown) is formed between the sidewalls 36 just forwardly of the first rearward wheel 18*c*, and a second horizontal brace (not shown) is formed between the first and second rearward wheels 18*c* and 18*d*. The top walls, sidewalls, and lower horizontal braces of the forward and rearward segments 26, 28 thus complete for each frame segment a stiff, elongate, box-like structure having good torsional rigidity. The torsional rigidity provided by the horizontal braces 40 (not shown) is desirable, but a frame constructed without crossbracing would also be within the scope of the present invention. Likewise, alternate crossbracing, such as diagonal internal crossbracing or external braces extending down from the base 14, could be utilized. The frame segments 26, 28 can be formed from any suitable rigid material, such as aluminum, titanium, other metals and alloys, engineering thermoplastics, and fiber-reinforced thermoplastics or thermosetting polymers.

Referring still to FIG. 3, the forward frame segment 26 includes left and right stabilizing flanges 50 secured to or integrally formed with the sidewalls 32 to form rearward extensions thereof. The stabilizing flanges 50 extend rearwardly of the innermost, i.e., second forward wheel 18*b*, toward the innermost, i.e., first rearward wheel 18*c*. The stabilizing flanges 50 can be welded (for metal materials), screwed, adhered, or riveted to the sidewalls 32 of the forward frame segment 26. Alternately, the forward frame segment 26 including the stabilizing flanges 50 can be integrally cast, molded or machined. The stabilizing flanges 50 have an internal spacing separating the two flanges such that they closely and slidably receive the forward ends of the sidewalls 36 of the rearward frame segment 28. In the preferred embodiment, the spacing between the stabilizing flanges 50 of the forward frame segment 26 is greater than the spacing between the remainder of the sidewalls 32 of the forward frame segment 26. Thus the sidewalls effectively expand externally, bending first laterally outward and then rearwardly, to define the stabilizing flanges 50.

FIG. 1 illustrates the stabilizing flanges 50 overlapping the forward ends of the sidewalls 36 of the rear frame segment 28. The overlap fit of the stabilizing flanges 50 and sidewalls 36 of the rear frame segment 28 is close, with the width from the outer surface of the left sidewall 36 to the outer surface of the right sidewall 36 being just slightly less than the width between the inner surfaces of the stabilizing flanges 50. This close fit is desirable so that the rearward frame segment 28 is substantially prevented from pivoting laterally, i.e., off longitudinal axis, relative to the forward frame segment 26. Thus, the stabilizing flanges 50 serve to torsionally couple the independent frame segments 26 and 28, particularly where the base 14 is unflexed as illustrated in FIG. 1. The frame segments 26 and 28 are coupled only by this overlap, and by virtue of both being secured to the base 14, and are preferably otherwise independent. This stabilizing overlap continues at least partially during all stages of flexure of the base 14.

To further increase the torsional rigidity of the frame assembly 16, the stabilizing flanges 50 are reinforced by a transverse stabilizing pin 52 inserted through aligned apertures formed through lower edge portions of the flanges 50. The stabilizing pin 52 is retained in place by a head on one end and a cap screw or a flare formed on the other end. The stabilizing pin 52 prevents the stabilizing flanges 50 from undesirably flaring outward or bending away from each other during use, maintaining them in spaced parallel disposition.

The forward ends of the sidewalls 36 of the rearward frame segment 28 each include a notch-like recess 54 that receives and accommodates the stabilizing pin 52 when the frame segments 26 and 28 are longitudinally aligned in the unflexed configuration, as shown in FIG. 1. This notch 54 allows the stabilizing pin 52 to be set rearwardly as far as possible for maximum transverse stabilization. In the preferred embodiment illustrated in FIG. 3, the rearward ends of the stabilizing flanges 50 taper downwardly in vertical width as they extend rearwardly. Conversely, the forward ends of the sidewalls 36 taper forwardly and upwardly in vertical width as they extend forwardly. This construction allows for maximum overlapping of the stabilizing flanges 50 and sidewalls 36. However, other configurations, including blunt ends on both the stabilizing flanges 50 and sidewalls 36, are possible. Further, rather than including distinct stabilizing flanges 50, as illustrated in FIG. 3, the sidewalls 32 of the forward frame segment 26 could simply have a greater width, or a rearward portion of the sidewalls 32 could be bent to define a greater width, to accommodate the rearward frame segment 28—all within the scope of the present invention.

Further, the stabilizing flanges could alternately be mounted on the rearward frame segment 28 and overlap the forward frame segment 26. Additionally, rather than side flanges, differing longitudinal projection(s) could be included on either the forward or rearward frame segment 26 or 28 to be closely and slidably received within a corresponding slot, recess, or space in the other of the forward or rearward frame segments.

Other than the overlapping of the stabilizing flanges 50, the forward and rearward frame segments 26 and 28 are independent of each other. Thus, the forward and rearward segments 26 and 28 are free to pivot and slide relative to each other during flexure of the base 14, without restriction. To further facilitate this sliding pivotal movement of the forward and rearward frame segments 26 and 28, a low friction surface, such as a Teflon™ fluoride polymer pad 56, is preferably applied to the exterior of the forward ends of each of the sidewalls 36 of the rearward frame segment 28. Alternately, the low friction pads 56 can be applied to the interior of the stabilizing flanges 50, or to both the stabilizing flanges 50 and the rear frame segment 28, although low friction materials, such as nylon pads, or bearings, could also be utilized. Thus, frictional resistance between movement of the forward and rearward frame segments 26 and 28 is minimized. The flexure of the base 14 is limited only by the skater's foot positioning and activity and the biasing of the base 14 (to be discussed below), rather than by the frame assembly 16.

Referring to FIGS. 1 and 3, the frame assembly 16 includes a mechanism for selectively locking the forward frame segment 26 to the rearward frame segment 28, so that the frame assembly 16 becomes rigid along its length. This may be desired, for instance, by beginning skaters who may be more comfortable on a rigid frame. In the preferred embodiment illustrated, a locking pin 58 having a head on one end and spring loaded detent ball on the opposing end, may be inserted if desired through aligned apertures 60 formed in each of the stabilizing flanges 50 and the forward ends of the sidewalls 36 of the rear frame segment 28. When the base 14 is unflexed such that the forward and rearward frame segments are longitudinally aligned, as shown in FIG. 1, the locking pin may be inserted if desired. Removal of the locking pin 58, by pushing of the locking pin 58 with an Allen wrench or other tool from the detent side, restores the skate to the flexing configuration.

Referring again to FIG. 3, each of the forward and rearward frame segments 26 and 28 is mounted to the base 14 for independent lateral and horizontal adjustment. For this purpose, the base 14 includes a spaced series of four transverse mounting slots 62. Each mounting slot 62 is bordered by a downwardly projecting boss. Each mounting slot 62 is reinforced by a corresponding slotted metal plate molded or adhered within the base 14, midway between the upper surface 30 and the lower surface 39. The reinforcing plates may be suitably formed of a metal such as aluminum, and each defines a lip 63 projecting internally about the perimeter of the corresponding slot 62. The head of a stud 64 is received within each slot from the upper surface of the base 14, and rests on the lip 63 defined by the reinforcing plate. Each stud 64 includes an internally threaded stem that extends downwardly through the slot 62 and lip 63. The studs 64 can be slid laterally from side to side along the length of the slots 62.

The top wall 31 of the forward frame segment 26 includes two longitudinally oriented mounting slots 66. The top wall 34 of the rearward frame segment 28 includes two longitudinally oriented mounting slots 66 as well. The longitudinal mounting slots 66 at the forward frame segment 26 are alignable with the two forwardmost transverse mounting slots 62 formed in the base 14. These forwardmost mounting slots 62 are formed within the forefoot region 20 of the base 14, just below the toes and just forwardly of the metatarsal head portion 22. Mounting bolts 68 are inserted from the underside of the forward frame segment 26, through the longitudinal slots 66 into the corresponding studs 64 to mount the forward frame segment 26 to the forefoot region 20 of the base 14. When the bolts 68 are loosely received in the studs 64, the forward frame segment 26 can be slid forwardly and rearwardly along the length of the slot 66, and can also be slid transversely left or right along the length of the slots 62. When the desired forward and rearward location and side to side location, as well as angulation, is achieved, the bolts 68 are tightened into the studs 64 to retain the forward frame segment in this position.

Similarly, mounting bolts 68 are inserted through the longitudinal slots 66 in the rearward frame segment 28, and into the studs 64 retained in the two rearmost transverse slots 62 of the heel region 24 of the base 14. The two rearmost transverse slots 62 are defined immediately below the heel and below the arch of the base 14. The rearward frame segment 28 can be longitudinally, laterally, and angularly adjusted, just as can the forward frame segment 26. The forward and rearward frame segments 26 and 28 can be adjusted independently of each other.

The adjustable mounting of the forward and rearward frame segments 26 and 28 makes possible the lengthening and shortening of the frame assembly 16 of the skate 10. A longer frame may be desired for increased speed, while a shorter frame may be desired for increased maneuverability. Likewise, the left and right positioning of the frame segments may be desired for individual skating styles to facilitate straight tracking or turning.

Referring to FIGS. 1 and 2, the mounting of the forefoot region 20 of the base 14 to the forward frame section 26 provides for a stable platform from which to push off of during the thrust portion of a skating stroke. Specifically, the point of flexure of the base 14, at the metatarsal head portion 22, is disposed either just above or forwardly of the axis of rotation of the innermost forward wheel 18*b* of the forward frame segment 26. The axis of rotation of the innermost forward wheel 18*b* is defined by the corresponding axle 45, and corresponds to the point of contact of the innermost forward wheel 18*b* with the ground. Thus, during flexure of the skate, when the rearward frame segment 28 and rearward wheels 18*c* and 18*d* are lifted off of the ground, a stable platform is still provided because the rearwardmost contact point with the ground provided by the wheel 18*b* is either immediately below or behind the point of flexure at the metatarsal head portion 22. This prevents the forward frame segment 26 from undesirably tipping upward, so that the forwardmost forward wheel 18*a* would rise off the ground during the thrust portion of the stroke.

Referring to FIGS. 2 and 4, the flexing skate 10 of the present invention preferably includes a biasing member to urge the base 14 downwardly to the lower or unflexed configuration of FIG. 1 and away from the upper or flexed configuration of FIG. 2. Preferably, this biasing is provided by a spring incorporated into the base 14 that is coplanar with the base 14. For example, the base 14 can be constructed from a resilient composite material, such as a thermosetting or thermoplastic polymer reinforced by fibers. One suitable example of such a resilient composite material is an epoxy reinforced with plies of carbon fibers, woven at 45°-angles relative to the longitudinal axis of the base 14. This construction results in the transverse metatarsal head portion 22 still retaining torsional stiffness, while also resiliently flexing longitudinally.

An alternate method of incorporating a spring into the base 14 is illustrated in FIG. 4. Specifically, a wide elongate recess 70 is formed in the upper surface 30 of the base 14. The recess 70 extends across a majority of the width of the base 14 and from the forward end of the toe region 20 of the base 14, just behind the forwardmost mounting slot 62, to approximately midway along the length of the base 14, just forwardly of the third mounting slot 62. This recess 70 receives a spring plate 72, which spans the width and most of the length of the recess. The spring plate 72 passes over and is centered on the metatarsal head portion 22. The spring plate 72 may be suitably formed as a strip of spring steel, or alternately may be a strip of other resilient material, such as a reinforced composite. The spring plate 72 is suitably adhered in place or may be retained by rivets. In the preferred embodiment, the spring plate is adhered between the base 14 and the upper shoe portion 12 on both the upper and lower surfaces during the lasting process. Additionally, four rivets 74 are inserted through the base 14 and each corner of the spring plate 72 through corresponding short longitudinal slots 76 formed in the spring plate 72. This allows some longitudinal shifting of the spring plate 72 relative to the base 14 during flexure of the base 14. The recess 70 may also include two transverse elastomeric strips 78 positioned forwardly and rearwardly of, and abutting, the forward and rearward ends of the spring plate 72. These elastomeric strips 78 compress and absorb the longitudinal movement of the spring 72, as permitted by the slots 76, during flexure of the base 14. Upon return of the base 14 to the unflexed configuration, the elastomeric strips 78 decompress, thereby further urging the spring 72 to its original configuration with additional force.

Referring to FIGS. 1 and 2, the spring plate 72 acts to urge the heel region 24 of the skate 10 downwardly to the unflexed configuration of FIG. 1. Moreover, the spring plate 72 is preferably preloaded such that it biases the heel region 24 of the base 14 downward sufficiently to introduce a negative camber to the longitudinal orientation of the wheels 18*a*, 18*b*, 18*c*, and 18*d*. Specifically, FIG. 1 illustrates a planar ground surface 96 across which a skater may traverse. Before the weight of the skater's body is introduced to the base 14, the skate 10 is biased by the spring plate 72 such that the intermediate wheels 18*b* and 18*c* are elevated slightly relative to the forwardmost wheel 18*a* and rearwardmost wheel 18*d*. Thus, the bottom surfaces of the wheels define a plane arcing slightly downwardly, as illustrated by line 98 in FIG. 1. As soon as the user's weight is applied to the base 14, the intermediate wheels 18*b* and 18*c* move downwardly as the preload of the spring plate 72 is overcome, until all wheels reside on the ground in an even planar configuration. The preloading of the spring plate 72 in this manner eliminates rockering of the skate 10, and may be utilized when an antirockering skate is desired. During each stroke as the skate begins to touch the ground, the intermediate wheels 18*b* and 18*c* will not initially contact the ground, eliminating undesired tracking during that portion of the stroke. The initial cambering of the wheels 18 ensures that proper contact of the forward and rearward wheels with the ground remains at all times.

While the preferred embodiment in FIG. 1 has been illustrated with four wheels, a differing number of wheels, more or less, could be utilized. For instance, a greater number of wheels, such as five wheels, may be desired for greater speed.

During skating on the flexing skate 10, the base 14 flexes about a laterally extending axis defined transverse to the longitudinal axis of the split frame assembly 16. However, the reduced thickness stress concentrating contour of the metatarsal head portion 22 may be oriented alternately, such as with a slight angle relative to the longitudinal axis of the frame assembly 16. This would thereby define a slightly angled transverse rotational axis that still more closely follows the contour of the metatarsal head of the skater's foot. The center of rotation of the base 14 and skate 10 is at a plane immediately below the metatarsal head of the skater's foot, and is preferred because centering rotation at other locations may cause the skater's foot to cramp. During skating, as the skater enters the push-off phase of the skating stroke, the skater utilizing the flexing skate 10 of the present invention may plantarflex his or her ankle, while flexing his or her foot above the metatarsal head portion 22 of the base 14. The forward frame segment 26 remains firmly on the ground as the rearward frame segment 28 elevates off the ground. The weight of the skater's foot pivots off the metatarsal head of the foot, and the weight of the skater bears down on the forward frame segment 26. A stable platform is provided by the two forwardmost wheels 18*a*, 18*b*, from which the skater is able to propel himself or herself forward. This skating action is more fully described in copending application Ser. No. 08/957,436, the disclosure of which is hereby expressly incorporated by reference.

During this push off or thrusting portion of the stroke, as the heel is lifted and the foot flexes, the spring plate 72 permits thrusting off of the forward end of the skate with greater power. The spring plate 72 bends at the metatarsal head portion 22 of the skate and the skate front loads the metatarsal head forward onto the remainder of the forefoot region 20 of the base 14. As soon as the stroke is completed and the user releases the tension from his or her foot, the spring 72 causes the heel region 24 of the base 14 to rebound to the unflexed configuration of FIG. 1, with energy being returned to the skate for a continued forward stride. Moreover, the preloading of the spring plate 72 causes the skate 10 to snap down firmly and positively into the aligned, unflexed configuration.

Utilization of the flexing base 14 of the skate 10 provides for greater control, particularly during longer strokes. The skate remains firmly under the weight of the user during the full length of a stroke, and the user is better able to maintain his or her center of gravity in a straight line. Thus longer strokes and greater speed are provided by use of the flexing skate 10 relative to a conventional rigid frame skate. Moreover, the split frame assembly 16 and flexing base 14 of the present invention provide the skater the ability to jump off of the forward frame segment 26, utilizing the spring action of his or her legs and feet as the foot is flexed during upward jumping movement, and rebounding after weight is removed from the skate to the unflexed configuration. Thus, jumping in the skate 10 of the present invention is possible even without the utilization of a ramp or other elevating device. The user instead simply springs off of the forward frame segment 26.

An additional benefit of the split frame configuration 16 and flexing base 14 is that the skate 10 thereby provides an integral suspension system. As the skate 10 passes over bumps and protrusions in the ground during skating, either of the forward frame segment 26 or rearward frame segment 28 can lift relative to the other, with the base 14 flexing as required accordingly, to dampen shock and impact to the skater's foot. Thus greater control and higher speeds are possible. The heel of the skater's foot is able to move up and down freely of the toe of the skater's foot. Full arcuate flexing of the foot is provided by the skate of the present invention, for enhanced maneuverability, speed, and jumping abilities.

Figure 5:
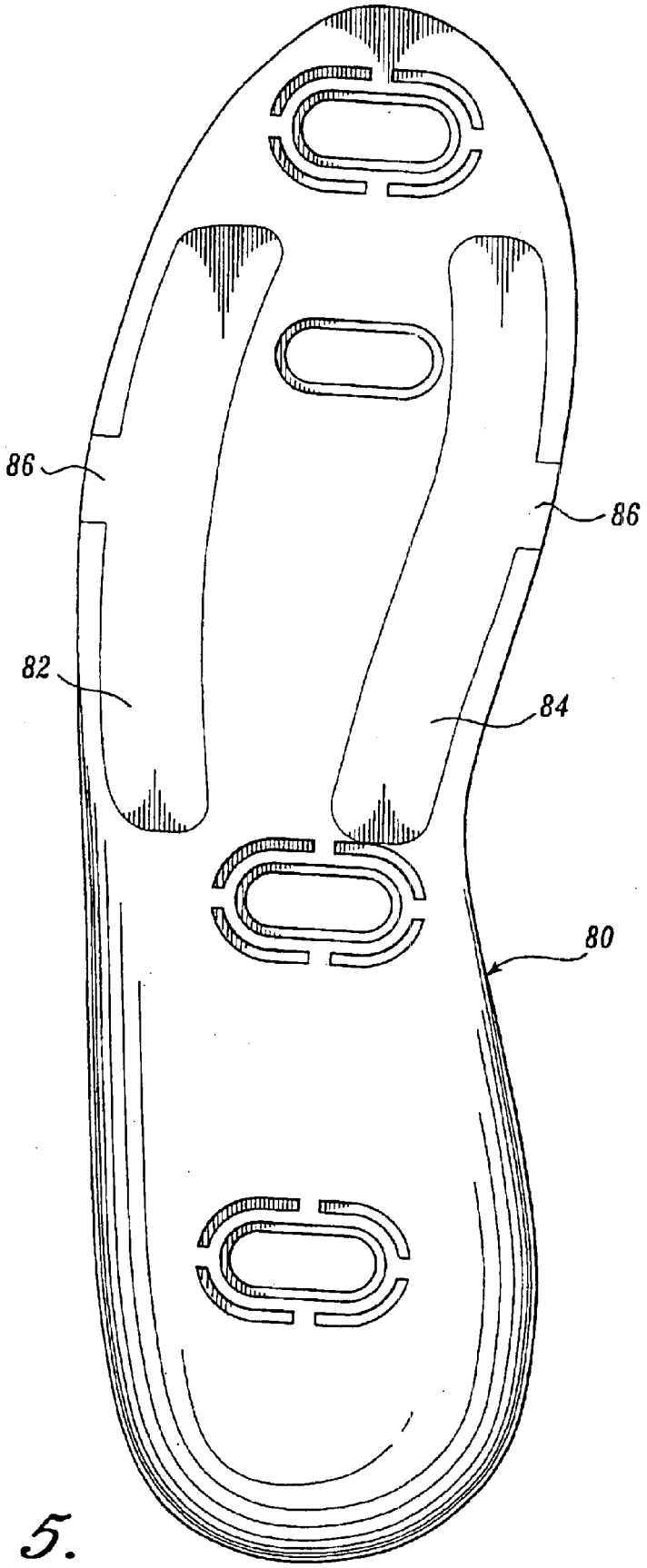
FIG. 5 provides a top plan view of an alternate embodiment of the base suitable for incorporation into the skate of FIG. 1, with interchangeable spring elements.

FIG. 5 provides a variation on the base 14 of the skate of FIG. 1. FIG. 5 illustrates an alternate base 80 that is configured the same as the base 14 previously described in most respects. However, rather than a single longitudinal recess 70 and spring plate 72, left and right narrow elongate spring strips 82 and 84 are mounted within corresponding elongate recesses along the left and right edges of the skate, again in the forefoot region 20 of the skate, and centered over the metatarsal head portion 22. The narrow spring strips 82 and 84 are inserted laterally into the base 80 through slots defined in the perimeter of the base 80. To this end, each of the spring strips 82 and 84 may include a tab 86 that is manually grasped, or grasped with pliers, for removal and installation of the spring strips 82 and 84. Once installed, the spring strips 82 and 84 are closely received within the recesses, and the preloading of the springs 82 and 84 retains them in this position. This construction enables the spring strips 82 and 84 to be removed and interchanged with differing spring strips having a higher or lower spring constant for more or less biasing force, as may be desired for particular users or applications. Other forms of interchangeable or adjustable biasing elements may be utilized, such as piezoelectric transducers, and are all within the scope of the present invention. Piezoelectric transducers would serve the functions of dampening vibration and controlling the amount of flexure and the amount of return flex or camber preload in response to varying surface conditions, providing a responsive suspension system.

Figure 6:
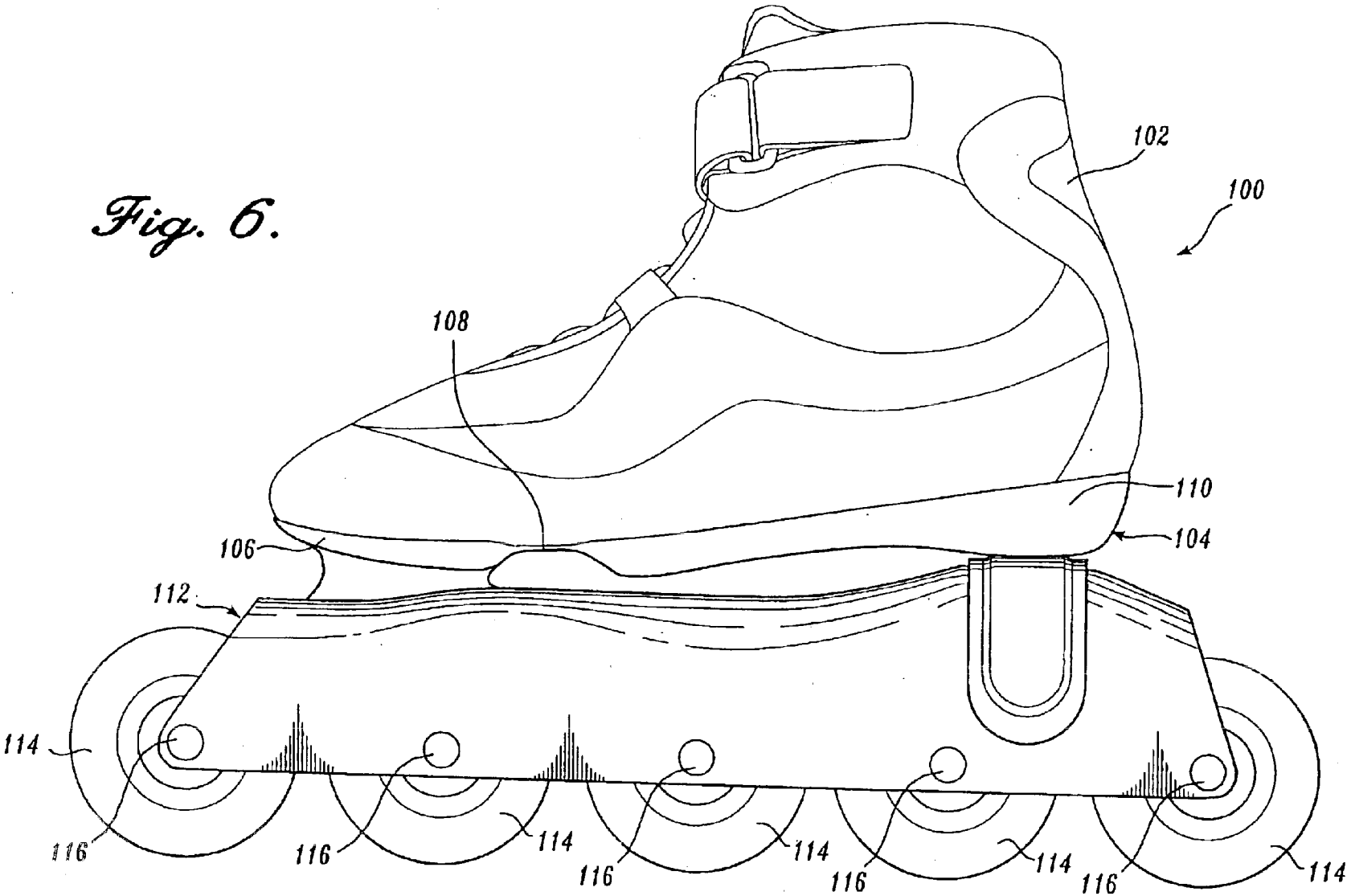
FIG. 6 provides a side view of a skate constructed in accordance with a second preferred embodiment of the present invention, having a rigid frame and flexing base, with the heel end of the base being free of the frame, shown in the unflexed configuration.
Figure 7:
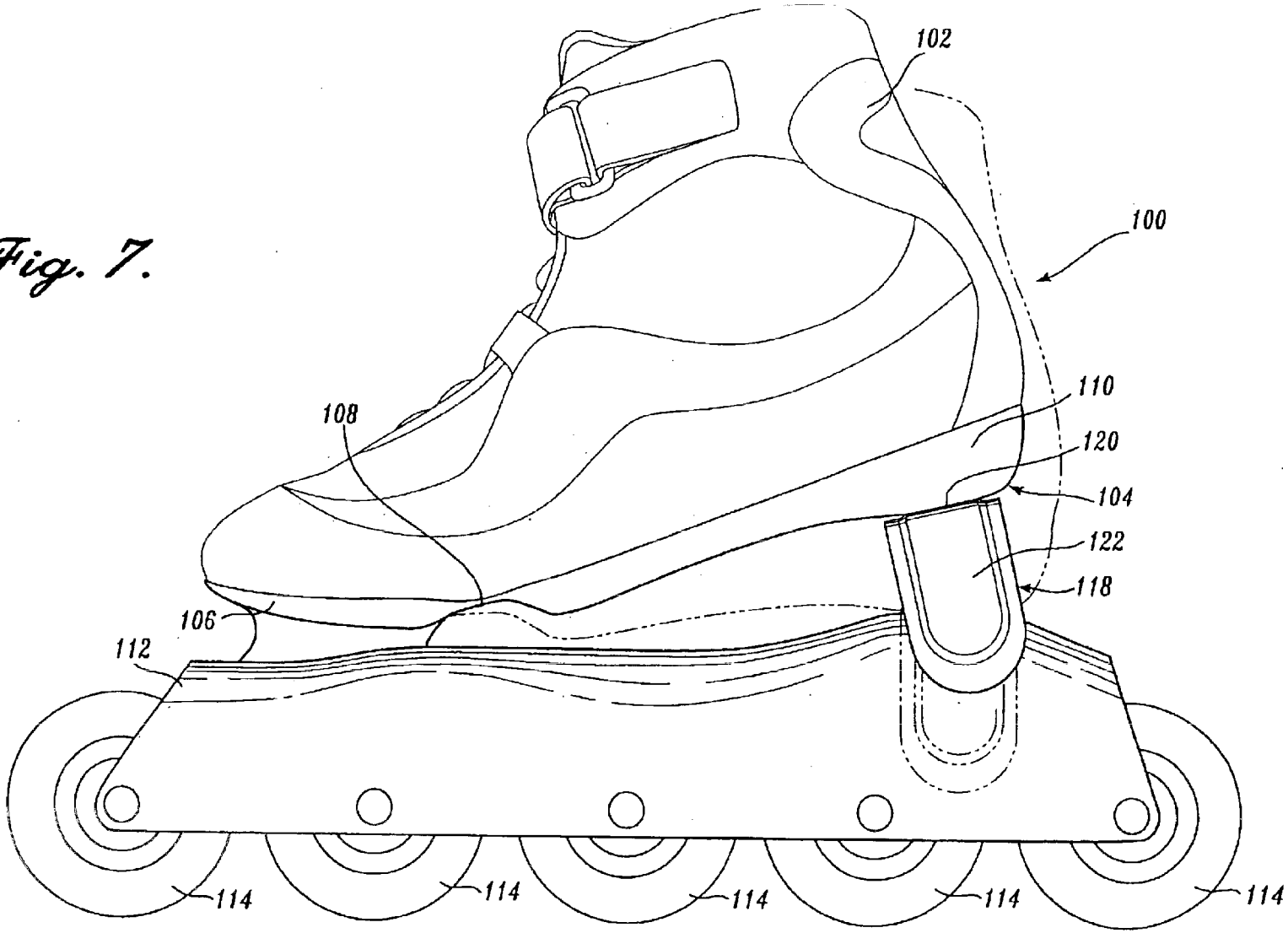
FIG. 7 provides a side view of the skate of FIG. 6 in the flexed configuration.

An alternate embodiment of a flexing base skate 100 is illustrated in FIGS. 6 and 7. The skate 100 again includes an upper 102 secured along its underside to a base 104. The upper 102 and the base 104 are constructed substantially similar to the upper 12 and base 14 of the previously described embodiment of the skate 10. In the skate illustrated in FIGS. 6 and 7, the upper 102 is configured as a racing skate boot; however other configurations of skate boots, such as that illustrated in FIG. 1, may alternately be utilized. The base 104 is constructed similarly to the base 14 illustrated in FIG. 1, and includes a forefoot region 106 having a metatarsal head portion 108 and a heel region 110. The base 104 incorporates a spring, which may suitably be the same as the previously described spring plate 72 illustrated in regard to the embodiment of FIGS. 1 through 4. Alternately, a differing spring construction, such as the use of a resilient composite material, is suitable for use in the embodiment of FIG. 6 to form the base 104 and integral spring.

FIG. 6 illustrates such a composite base and spring, suitably constructed from a composite with fibers oriented at 45° relative to the longitudinal axis of the skate. Thus, the base 104 is of one piece construction, with the contour of the base 104 at the metatarsal head portion 108 providing for flexure of the base below the metatarsal head of the foot, and the composite material utilized to form the base 104 providing the spring force for biasing of the base 104 to the unflexed configuration shown in FIG. 6. The base 104 is also preferably longitudinally reinforced so that it is rigid in front of and rearwardly of the flexible metatarsal head portion 108. Longitudinal reinforcement may be had through the incorporation of ribs, as in the previously described embodiment. Alternately, syntactic foam reinforcing strips or other reinforcing members may be incorporated into the structure of the base 104 rearwardly and forwardly of the metatarsal head portion 108.

Skate 100 also includes a rigid longitudinal frame 112. Unlike the previously described embodiment, the frame 112 has a one-piece construction and extends the full length of the skate. The frame 112 may suitably be formed from a composite material having a downwardly opening, U-shaped, elongate channel configuration to define opposing left and right sidewalls. Alternate frame constructions, such as a torsion box construction such as that previously described, but extending in one piece along the length of the skate, may be utilized. The skate 100 further includes a plurality of wheels 114 journaled on axles 116 between the opposing sidewalls of the frame.

The forefoot region 106 of the base 104 is secured to the forward end of the frame 112. The securement may be by two bolts (not shown) that are longitudinally spaced, that pass through apertures defined in the upper wall of the frame 112, and that are received within threaded inserts molded into or captured above the upper surface of the base 104. Alternate constructions, such as studs that extend downwardly from the base 104 and that receive nuts received within the frame 112, or riveting, may be utilized. The base 104 is fixedly secured to the frame 112 only at the forefoot region 106. The base 104 is not secured and is free of the frame 112 at the metatarsal head portion 108 and rearwardly behind the metatarsal head portion 108, including the heel region 110. Thus, the heel region 110 of the base 104 may be elevated or lifted above and away from the frame 112, with the base 104 flexing at the metatarsal head portion 108, as shown in the flexed configuration of FIG. 7. Just as in the previously described embodiment, the user may flex his or her foot to lift his or her heel during the skating stroke. However, the full length of the frame 112 remains parallel to the ground, with all of the wheels 114 contacting and rolling on the ground.

Although the heel region 110 of the base is able to elevate from the frame 112 during skating, it is still desired to maintain the heel region 110 centered above the base 112 and to avoid torsional twisting of the base 104 that would result in the heel region 110 being displaced laterally to either side of the frame 112. Torsional rigidity is provided to the base 104 in part by the selection of materials utilized to construct the base 104. Thus, in the preferred embodiment utilizing a composite material, the reinforcing fibers provide a high degree of torsional rigidity while permitting flexing at the metatarsal head portion 108. Further lateral stability and alignment of the base 104 relative to the frame 112 are provided by a guide member 118 secured to the lower surface of the base 104, immediately below the rear end of the heel region 110.

The guide member 118 of the preferred embodiment illustrated has an elongate, U-shaped configuration, including a center top portion 120 that is bolted, riveted, or otherwise secured to the base 104. The guide 118 further includes first and second side flanges 122 that depend perpendicularly downwardly from the top portion 120, on either side of the frame 112. The frame 112 is slidably and closely received between the left and right side flanges 122. The guide 118 is preferably constructed with a high degree of rigidity. The guide 118 may suitably be constructed from a laminate of syntactic foam surrounded and encapsulated within inner and outer layers of reinforced composite material. Other materials, such as aluminum, may alternately be utilized. Preferably, a low friction surface is formed on either the frame 112 sidewalls or the interior of the guide 118, so that the two members slide easily relative to each other.

During flexure of the skate between the lower, unflexed configuration of FIG. 6 and the upper, flexed configuration of FIG. 7, the frame 112 remains fully or partially between the opposing side flanges 122 of the guide 118. The heel region 110 of the base 104 thus remains centered over the frame 112 with a high degree of lateral stability. The ability to lift the heel of this flexing base skate 100 provides an unencumbered movement of the heel due to the low weight carried by the heel. The spring incorporated into the base 104 provides the same benefits as in the previously described embodiment, serving to bias the base 104 downwardly to the lower position of FIG. 6. The spring incorporated into the base 104 is preferably preloaded such that the base 104 is biased positively against the frame 112. The advantages provided by flexing the base 104 and skate upper 102 at the metatarsal head portion are also provided by this embodiment of the present invention. However, in the embodiment of FIGS. 6–7, all wheels maintain contact with the ground until the very end of the skating stroke, for added power and stability and that tracks well for fitness and racing applications.

Figure 8:
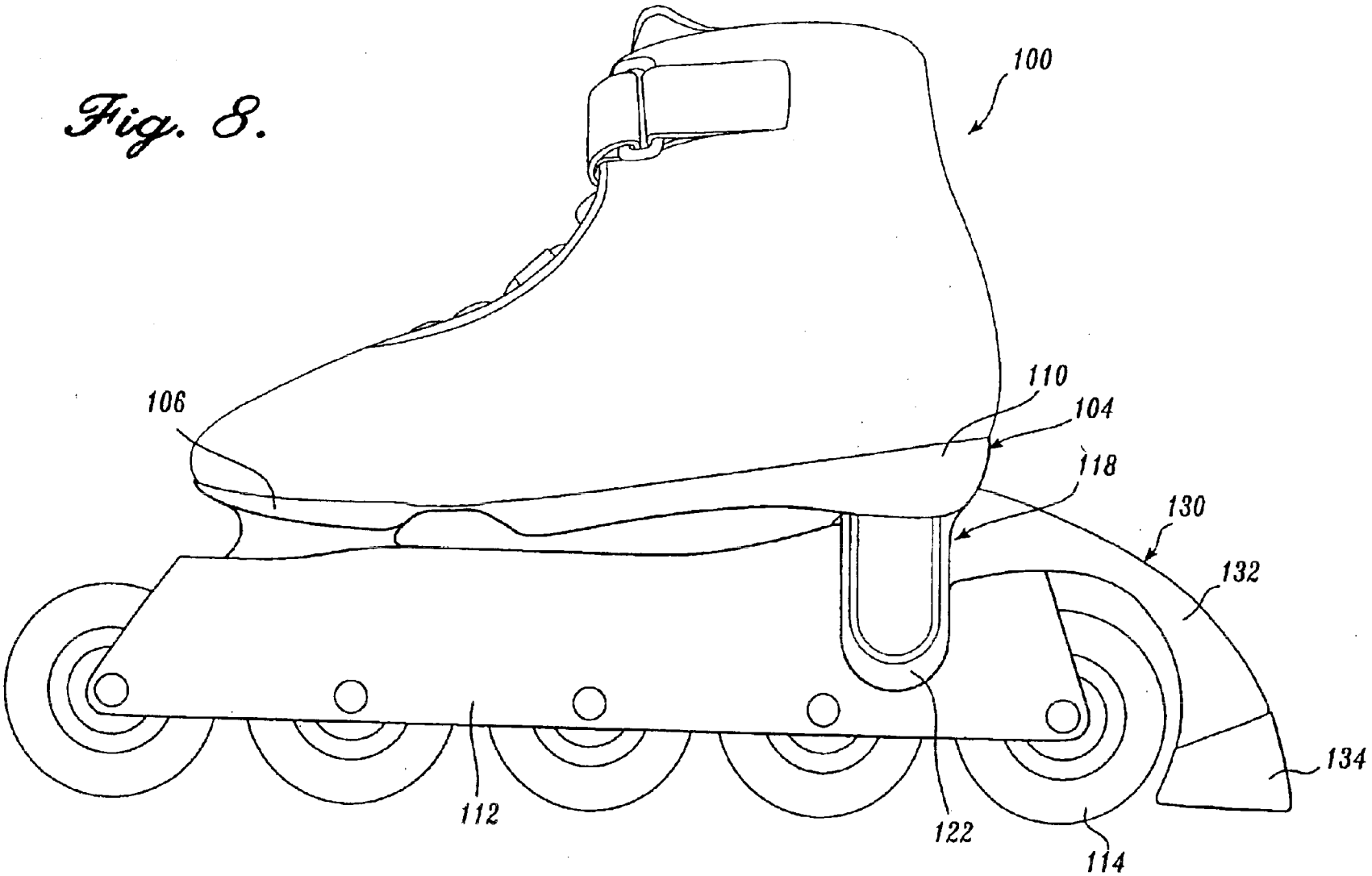
FIG. 8 provides a side view of alternate configuration of the skate of FIG. 6 including a brake element mounted on the base of the skate, in the unflexed configuration.

FIG. 8 illustrates the flexing base skate 100 that is provided with a brake assembly 130. The brake assembly 130 includes a brake arm 132 having an upper end secured to the heel region 110 of the base 104, and that extends rearwardly and downwardly therefrom, terminating rearwardly of the rearmost wheel 114. An elastomeric brake pad 134 is mounted, such as by a screw, to the rear end of the brake arm 132.

Figure 9:
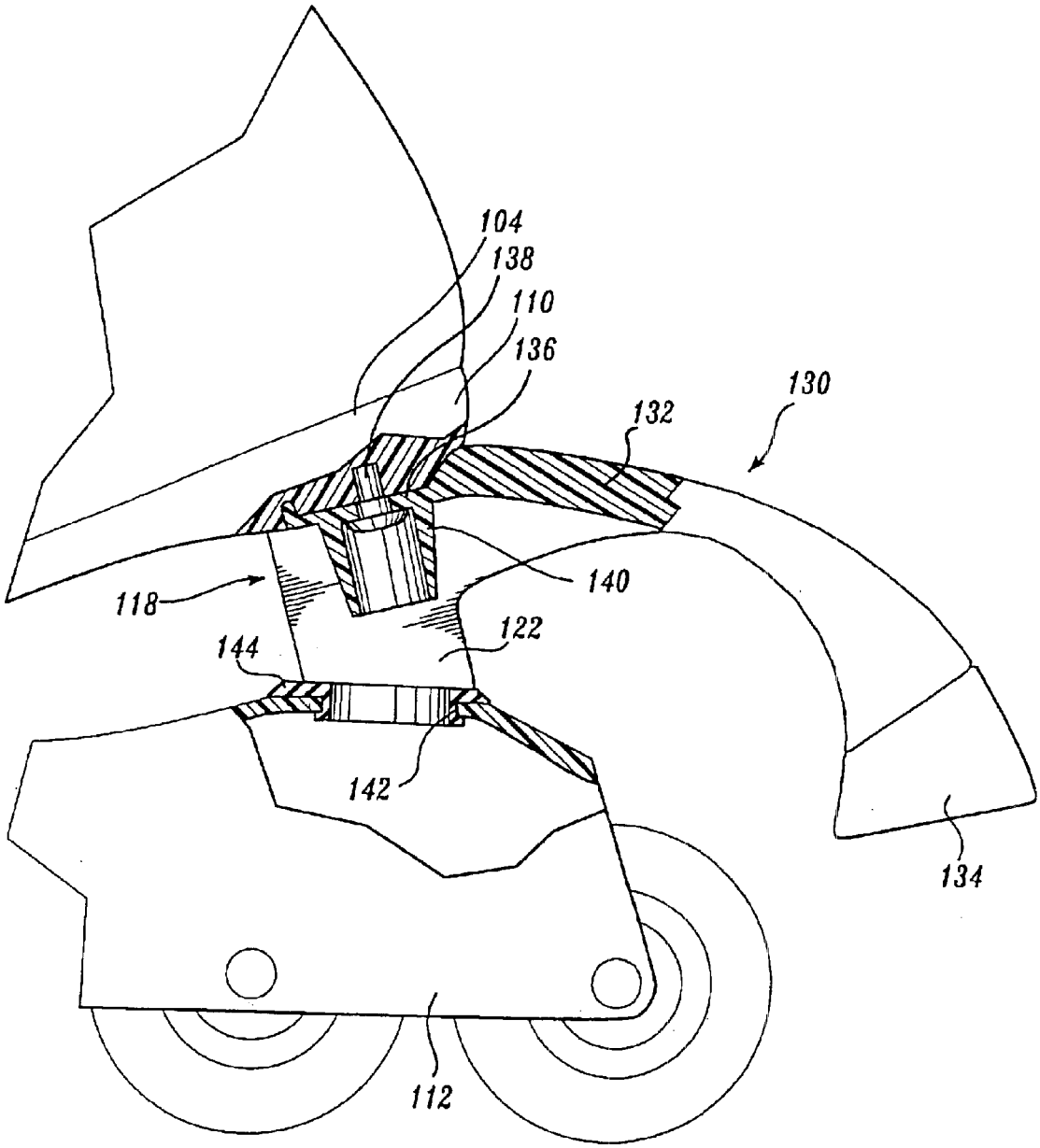
FIG. 9 provides a detailed, partial cross-sectional side elevation view of the skate of FIG. 8 in the flexed configuration, with the guide member shown in phantom.

The construction and mounting of the brake arm 132 is illustrated in FIG. 9. The brake arm 132 has a flattened upper portion 136 that is secured by a bolt 138 to the heel region 110 of the base 104. The guide 118 is integrally formed with the brake arm 132. Thus the upper portion 136 of the brake arm 132 serves as the top surface 120 of the guide element 118. The side flanges 122 of the guide 118 depend downwardly from the upper surface 136 on either side of the frame 112. To further guide the alignment of the base 104 relative to the frame 112 during the initial stages of flexure, the brake arm 132 also includes a tapered cylindrical guide boss 140 projecting centrally downward from the top surface 136. The guide boss 140 does not extend downwardly as far as the side flanges 122. The guide boss 140 is slidably received within a slotted aperture 142 defined in the upper wall of the frame 112. Thus, when the skate is in the unflexed configuration of FIG. 8, the guide boss 140 is received within the slotted aperture 142, and further laterally fixes the base 104 relative to the frame 112. In this configuration, as shown in FIG. 8, the brake pad 134 is adjacent the ground. By rocking back on the rearwardmost wheel 114, the user can bring the pad 134 into engagement with the ground for braking action. During flexing of the skate 100, the brake assembly 130 travels upwardly with the heel of the skate. This construction avoids the excessive lever arm effect that may alternately result if the brake assembly were instead mounted to the frame 112.

It should be readily apparent that the centered guide boss 140 could also be incorporated into the guide 118 of FIGS. 6 and 7, whether or not the brake arm 132 is incorporated.

The free heel flexing skate of FIGS. 6 through 9 provides a shock absorption system similarly to the first preferred embodiment described previously. Thus, the heel of the skate can pivot upwardly off of the frame 112 upon passing over protuberances in the ground. The biasing of the spring incorporated into the base 104, however, prevents undesirable chattering of the base 104 relative to the frame 112. Further shock absorption may be provided by an elastomeric dampening element mounted between the base 104 and the frame 112. Thus, FIG. 9 illustrates an elastomeric grommet 144 that is fitted about the perimeter of the slotted aperture 142, including an upper lip that projects above the frame 112. When the base 104 is pivoted downwardly to the lower position, it contacts the elastomeric grommet 144, which serves to cushion the two members and dampen vibrations and shock therebetween.

It should be readily apparent to those of ordinary skill in the art that alterations could be made to the above-described embodiment. For instance, an elastomeric member could be mounted to other locations of the frame or on the base 104. Further, the guide member could be mounted on the frame to extend downwardly on either side of the base, rather than the guide member projecting downwardly on either side of the frame. Also, a guide member could alternately project upwardly from the frame and engage an aperture defined in a rearward extension of the base.

A third embodiment of a flexing base skate 210 constructed in accordance with the present invention is illustrated in FIGS. 10 through 13. The skate 210 includes an upper shoe portion 212 that is mounted on and secured to a base 214 that is flexible below the metatarsal head of the skater's foot. The base 214 is secured to a split frame assembly 216 that extends longitudinally beneath the base 214 and rotatably connects to a plurality of wheels 218A, 218B, 218C, 218D between first and second opposing longitudinal sidewalls. The base 214 includes a forefoot region 220 having a metatarsal head portion 222 that underlies the metatarsal head of a skater's foot, and a heel region 224 underlying the skater's heel. The frame assembly 216 includes a forward frame segment 226 secured to the forefoot region 220 of the base 214, and a rearward frame segment 228 that is secured to the heel region 224 of the base 214.

The forward frame segment 226, rearward frame segment 228, and flexible base 214 cooperate to permit the skater's foot and the upper shoe portion 212 to flex at a metatarsal portion 222 of the base 214 during the skating stroke. The base 214 and upper shoe portion 212 flex from a lower position, illustrated in FIG. 10, in which the wheels 218A, 218B, 218C, 218D are linearly aligned, and a flexed, upper position illustrated in FIG. 11, in which the heel region 224 of the base 214 and rearward frame segment 228 pivot upwardly relative to the forefoot region 220 of the base 214 and forward frame segment 226. Each of the components of the skate 210 will now be described in greater detail.

Figure 10:
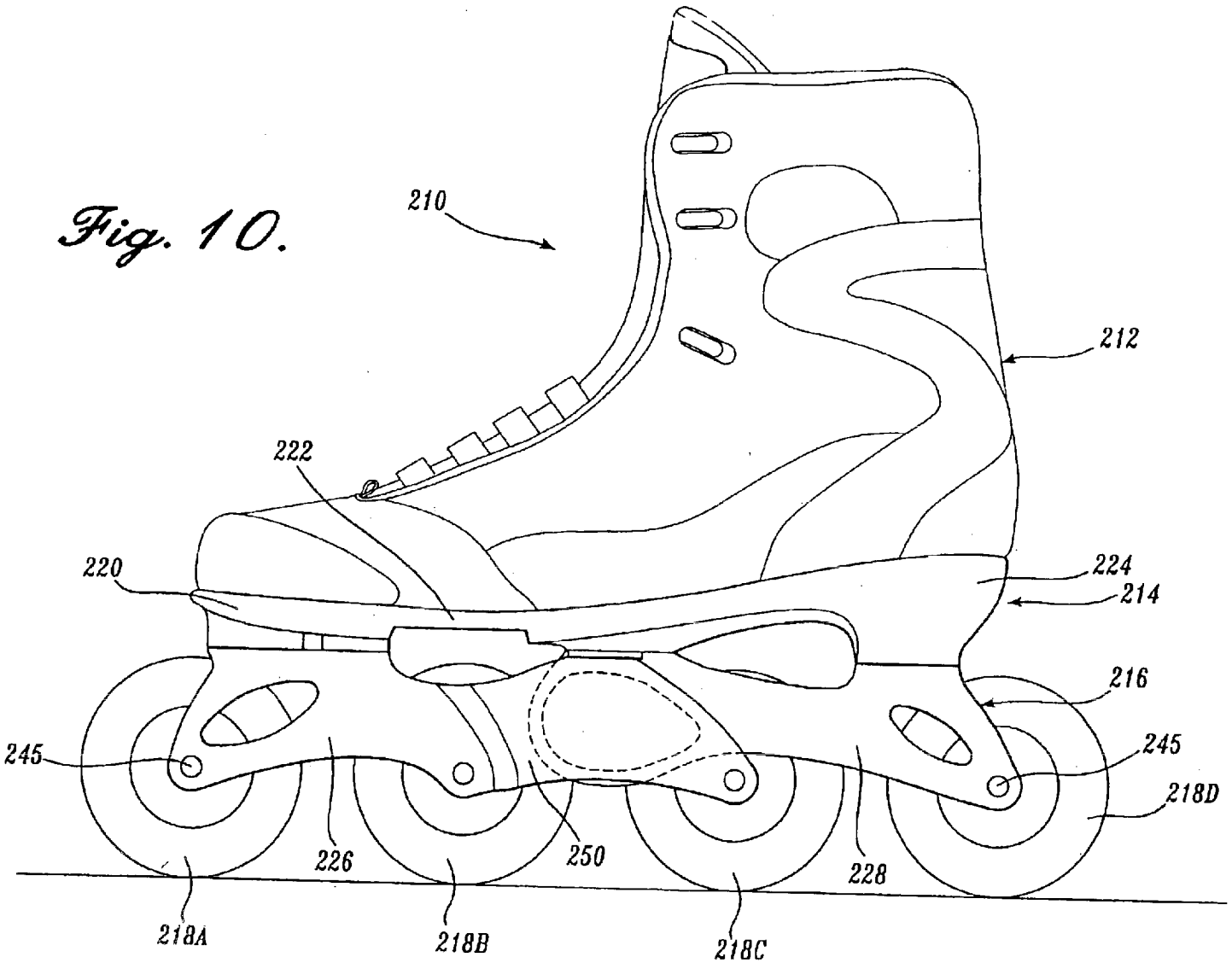
FIG. 10 provides a side view of a skate constructed in accordance with a third embodiment of the present invention shown in an unflexed configuration.
Figure 11:
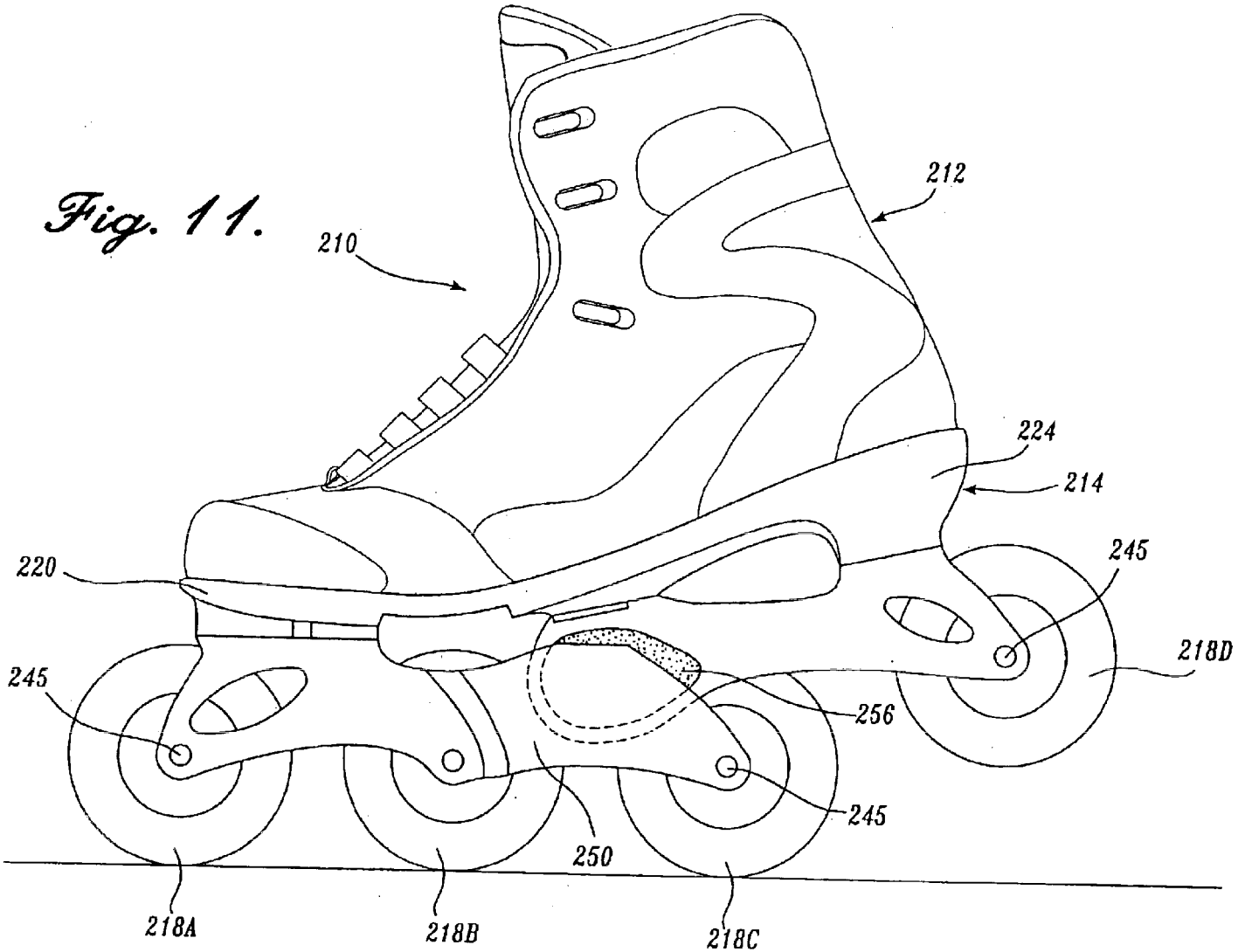
FIG. 11 provides a side view of the skate of FIG. 10, with the skate in the flexed configuration.

Referring to FIGS. 10 and 11, the upper shoe portion 212 surrounds the toes, sides, heels, and ankle of a skater's foot and is constructed at least partially from flexible materials so that the upper shoe portion 212 will flex together with the base 214. The base 214 is best viewed in FIGS. 10 and 12. The base 214 is secured to the upper shoe portion 212 by any conventional method and may optionally include rigidizing ribs (not shown) similar to the ribs 41 described above. The flexibility of the metatarsal head portion 222 of the base 214 is enhanced by the formation of a transverse, elongate aperture 242 (shown in FIG. 12) that extends transversally and centrally across approximately half of the width of the metatarsal head portion 222, in exactly the same manner as the elongate aperture 42 described with respect to the first embodiment shown in FIG. 1. Thus, the base 214 and upper shoe portion 212 flex at the anatomically preferred position just below the metatarsal head or the skater's foot, following the natural contour of the metatarsal head as it flexes.

Figure 12:
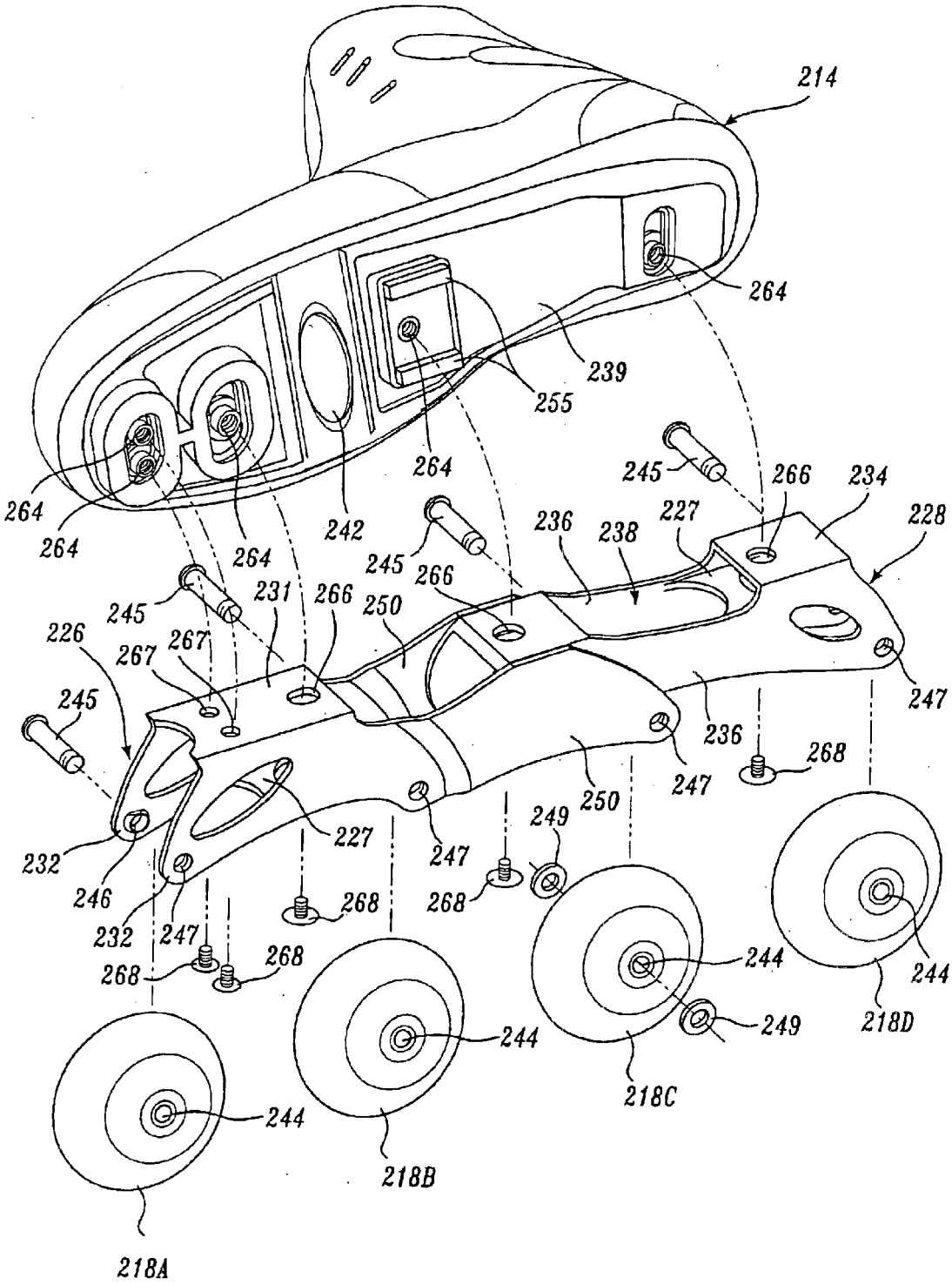
FIG. 12 provides an exploded pictorial view of the skate of FIG. 10.
Figure 19:
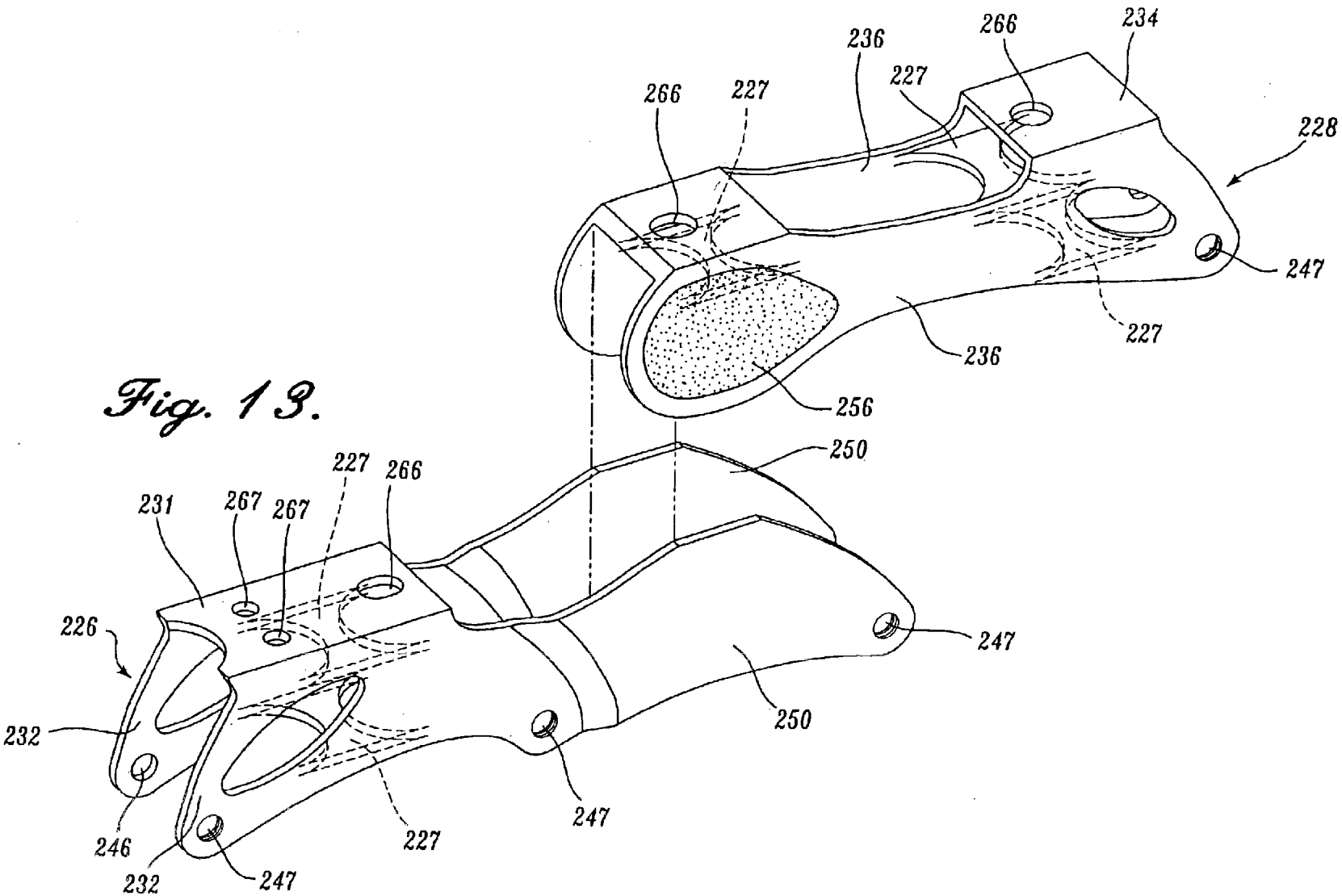

Attention is now directed to FIGS. 12 and 13 to describe the construction of the split frame assembly 216. The forward frame segment 226 and the rearward frame segment 228 have independent torsion box construction. The forward frame segment 226 has a top wall 231, left and right opposing sidewalls 232, and a pair of vertically separated horizontal braces 227 that are disposed between the two forward wheels 218A and 218B. The rear frame segment 228 correspondingly includes a top wall 234, left and right sidewalls 236, a forward horizontal brace 227 disposed between the middle wheels 218B and 218C, and a pair of vertically separated horizontal braces 227 disposed between the rearward wheels 218C and 218D. The top wall 234 runs from beneath an arch portion 239 of the heel region 224 of the base 214, to the rear end of the heel region 224. A weight-reducing aperture 238 is cut out from the center of the top wall 234. The top walls 231 and 234 of the forward and rearward frame segments 226 and 228 are horizontally oriented, with the sidewalls 232 and 236 projecting perpendicularly downward therefrom. The top walls, sidewalls, and lower horizontal braces of the forward and rearward segments 226, 228 thus complete for each frame segment a stiff, elongate, box-like structure having good torsional rigidity.

The forward frame segment 226 includes rearwardly extending left and right stabilizing flanges 250 secured to or integrally formed with the sidewalls 232. The stabilizing flanges 250 are disposed parallel to each other and spaced apart such that the two flanges 250 closely and slidably receive the forward ends of the sidewalls 236 of the rearward frame segment 228. The spacing between the stabilizing flanges 250 of the forward frame segment 226 is preferably greater than the spacing between the remainder of the sidewalls 232 of the forward frame segment 226.

As best seen in FIGS. 12 and 13, the stabilizing flanges 250 overlap the forward ends of the sidewalls 236 of the rear frame segment 228. The overlap fit of the stabilizing flanges 250 and sidewalls 236 of the rear frame segment 228 is close, with the rear frame width measured from the outer surface of the left sidewall 236 to the outer surface of the right sidewall 236 being just slightly less than the forward frame gap width measured between the inner surfaces of the stabilizing flanges 250. This close fit is desirable so that the rearward frame segment 228 is substantially prevented from pivoting laterally, i.e., off longitudinal axis, relative to the forward frame segment 226. Thus, the stabilizing flanges 250 serve to torsionally couple the frame segments 226 and 228. The frame segments 226 and 228 are coupled only by this overlap, and by virtue of both being secured to the base 214, and are preferably otherwise independent. This stabilizing overlap continues at least partially during all stages of flexure of the base 214. While the preferred embodiment illustrated in FIG. 12 shows the forward frame segment 226 overlapping the rearward frame segment 228, it should be apparent based on the disclosure herein that the frame segments could equivalently be configured such that the rearward frame segment overlap the forward frame segment.

In this third embodiment the forward frame segment 226 carries a first forward wheel 218A and a second forward wheel 218B journaled between the opposing sidewalls 232, and a third forward wheel 218C journaled between the opposing stabilizing flanges 250 of the sidewalls 232. Each wheel includes a center hub and bearing assembly 244 that are mounted rotatably on an axle 245. Each axle 245 is inserted through an aperture 246 on one of the sidewalls 232, and threadably engages an aligned and threaded aperture 247 on the opposite sidewall 232. The stabilizing flanges 250, which overlap the rear frame segment 228 as discussed above, are spaced further apart than the sidewalls 236. In the preferred embodiment, annular axle spacers 249 having a thickness approximately equal to the thickness of the sidewalls 236 are provided on either side of the third forward wheel 218C, between the hub and bearing assembly 244 and the stabilizing flanges 250. It will be apparent to one of skill in the art that other options for providing the correct wheel spacing are also possible—for example, the stabilizing flanges could be offset inwardly near the back end, or the hub and bearing 244 of the third wheel 218C could be modified to provide the desired spacing. Further, while three wheels are preferably mounted in the forward frame segment 226, alternatively only two forward wheels could be utilized, within the scope of the present invention.

The rearward frame segment 228 carries a rearward wheel 218D journaled between its sidewalls 236. The rearward wheel 218D is similarly provided with a hub and bearing assembly 244 that is rotatably mounted on an axle 245. While the preferred embodiment illustrated mounts only a single wheel on the rearward frame segment 228, alternatively, two wheels could be utilized.

It will be appreciated that this third embodiment allows the skater's foot to flex in a natural location near the metatarsal region of the foot, while simultaneously providing a relatively stable platform for the skater wherein the three forward wheels 218A, 218B, 218C, maintain contact with the skating surface. Moreover, comparing FIG. 11 with FIG. 2, it will be appreciated that a longer overlap length is provided between the stabilizing flanges 250 and the rear frame segment 228, which advantageously increases the longitudinal stability between the frame segments 226, 228. Finally, it is also noted that the stabilizing pin 52 in the first embodiment, shown most clearly in FIG. 3, is not necessary in this third embodiment because the third wheel 218C and axle 245 will maintain the desired spacing in the stabilizing flanges 250. The rearmost axle 245 on the forward frame segment 226, at the rearward end of the stabilizing flanges 250, ties the stabilizing flanges 250 together laterally to prevent distortion of the flanges 250 out of a parallel disposition along their full length. The rearmost axle 245 of the forward frame segment 226 is disposed rearwardly of the forwardmost point of connection of the rearward frame segment 228 to the base 214 for stability.

The forward and rearward frame segments 226 and 228 are independent of each other, except for the stabilizing flanges 250 overlapping the rearward frame segment 228, and the interconnection through the base 214. Thus, the forward and rearward segments 226 and 228 are free to pivot and slide relative to each other during flexure of the base 214 along the longitudinal axis. To further facilitate this sliding pivotal movement of the forward and rearward frame segments 226 and 228, a low-friction surface, such as a Teflon™ fluoride polymer pad 256, is preferably applied to the exterior of the forward ends of each of the sidewalls 236 of the rearward frame segment 228. Alternately, the low friction pads 256 can be applied to the interior of the stabilizing flanges 250 or to both the stabilizing flanges 250 and the rear frame segment 228.

Referring again to FIG. 12, each of the forward and rearward frame segments 226 and 228 is mounted to the base 214, utilizing a plurality of mounting bolts 268 that threadably engage nut studs 264 in the base 214, similar to the attaching means described above for the first embodiment 10. In this third embodiment of the skate 210, the forward end of the forward frame segment 226 attaches to the base 214 with two mounting bolts 268. When the skater executes a thrusting stroke, the stress is primarily transmitted through the forefoot region 220 of the base 214 to the forward frame segment 226. The optional two-bolt attachment at the forward end of the forward frame segment 226 will accommodate these thrusting stresses. A third mounting bolt 268 attaches the forward frame segment 226 to the base 214 rearward of the forward two mounting bolts 268.

The rearward frame segment 228 is attached to the base 214 through orifices 266, 267 at forward and rearward portions of the top walls 231 and 234 that align with nut studs 264 in the base 214. A pair of narrow, elongate, elastomeric bumpers 255 is provided in the base 214, disposed symmetrically on opposite sides of the nut stud 264 above the forward end of the rearward frame segment 228, and spaced to engage the upper portion of the stabilizing flanges 250 when the base 214 is in the lower, unflexed position shown in FIG. 11. The elastomeric bumpers 255 act as a shock absorber—for example, when the skate 210 transitions from the flexed to the unflexed position—and protects the bottom surface of the base 214 from undesirable wear that might otherwise result from repeated impacts and/or rubbing from the stabilizing flanges 250.

A greater number of wheels, such as five wheels, may be desired for greater speed. A fourth embodiment of a flexing base skate 310, constructed in accordance with the present invention, is shown in FIGS. 14–17. The skate 310 includes an upper shoe portion 312 that is attached to a flexible base 314, having a forefoot region 320 that includes a metatarsal head portion 322, and a heel region 324. The base 314 is attached to a split frame assembly 316 that supports five wheels 318 that are rotatably mounted on axles 345. The forward frame segment 326 includes a horizontal top wall 331, two parallel side walls 332 depending vertically from the top wall 331, and a horizontal brace 327 to form a sturdy box frame structure. The rearward frame segment 328 similarly includes a horizontal top wall 334, two parallel sidewalls 336, and a horizontal brace 327, also forming a sturdy box frame structure. Three forward wheels 318 are rotatably journaled on axles 345 between the sidewalls 332 of the forward frame segment 326, and two rearward wheels 318 are rotatably journaled on axles 345 between the sidewalls 336 of the rearward frame segment 328.

The forward frame segment 326 includes stabilizing flanges 350 depending rearwardly from the sidewalls 332 of the forward frame segment 326, and are spaced apart to slidably engage the forward portion of the sidewalls 336 of the rearward frame segment 328.

Figure 14:
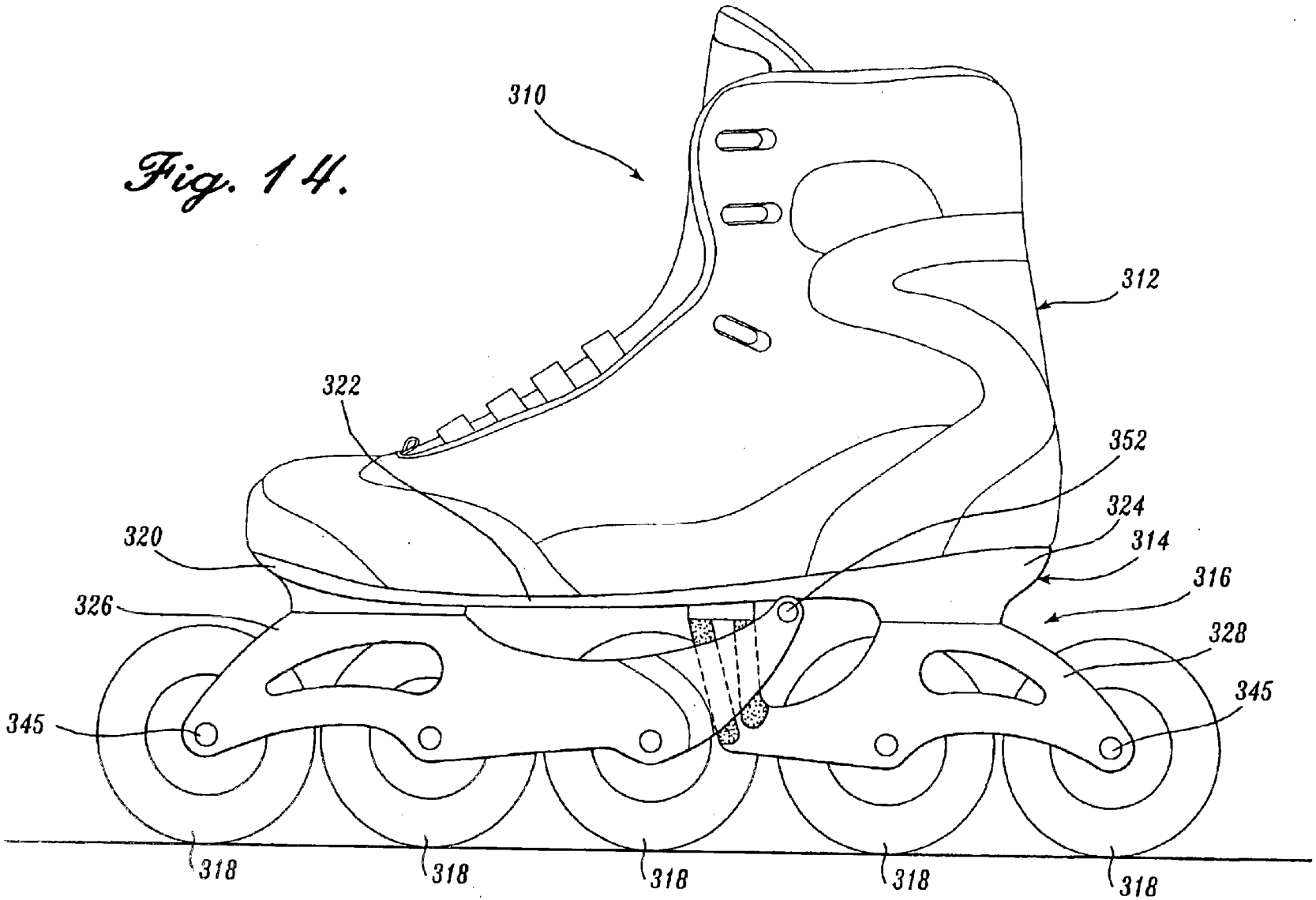
FIG. 14 provides a side view of a skate constructed in accordance with a fourth embodiment of the present invention, shown in an unflexed configuration.
Figure 15:
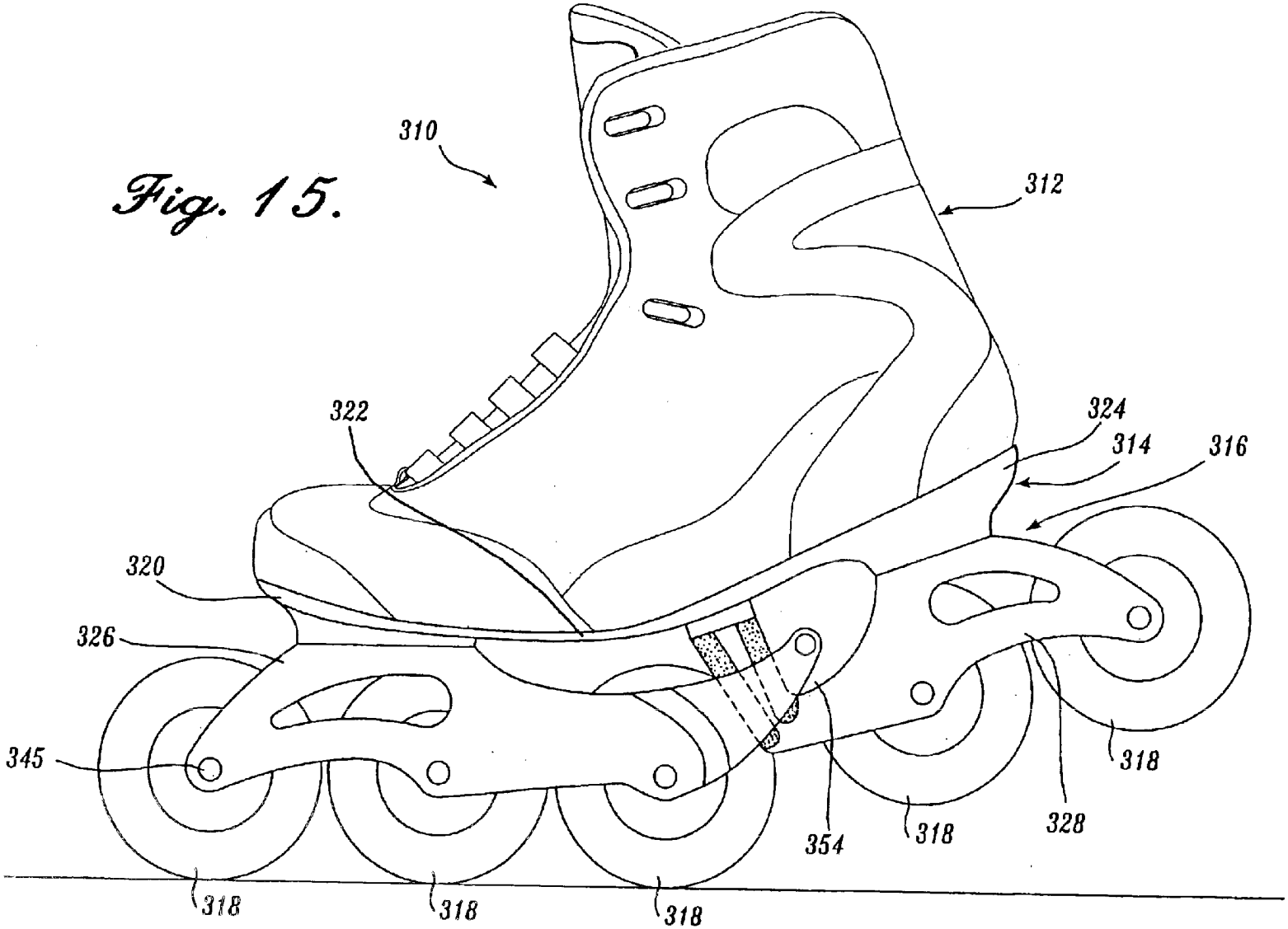
FIG. 15 provides a side view of the skate of FIG. 14 with the skate in the flexed configuration.

The skate 310 can flex from an unflexed, lower position shown in FIG. 14 to a flexed, upper position shown in FIG. 15. In the flexed position (generally produced during the skater's thrust stroke), the heel region 324 of the base 314 and the rearward frame segment 328 pivot with respect to the forefoot region 320 of the base 314 and the forward frame segment 326, lifting the two rearward wheels 318. Three wheels 318, therefore, remain in contact with the skating surface during the thrust stroke, providing a stable base for the skater. As with the previous embodiments, the base 314 is designed to preferentially flex in the metatarsal head portion 322 generally underlying the metatarsal head of the skater's foot. To further facilitate this sliding pivotal movement of the forward and rearward frame segments 326 and 328, low friction strips 356 are preferably applied to the exterior of the forward ends of each of the sidewalls 336 of the rearward frame segment 328.

The split frame assembly 316 attaches to the bottom side of the base 314 with a plurality of axially-spaced mounting bolts 368 that are inserted through slotted or circular apertures 366 in the top walls 331, 334 of the forward and rearward frame segments 326, 328. The mounting bolts 368 threadably engage nut studs 364 provided in the base 314. To further increase the torsional rigidity of the frame assembly 316, the stabilizing flanges 350 are reinforced by a transverse stabilizing pin 352 inserted through aligned apertures formed through the rearward edge portions of the flanges 350. The stabilizing pin 352 prevents the stabilizing flanges 350 from undesirably flaring outward or bending away from each other during use, maintaining them in spaced parallel disposition. The stabilizing pin 352 is accommodated by and passes through apertures 354 formed in the sidewalls of the rearward frame segment 328, between the points of attachment to the base 314 by bolts 368, within the upper portion of the sidewall.

Figure 16:
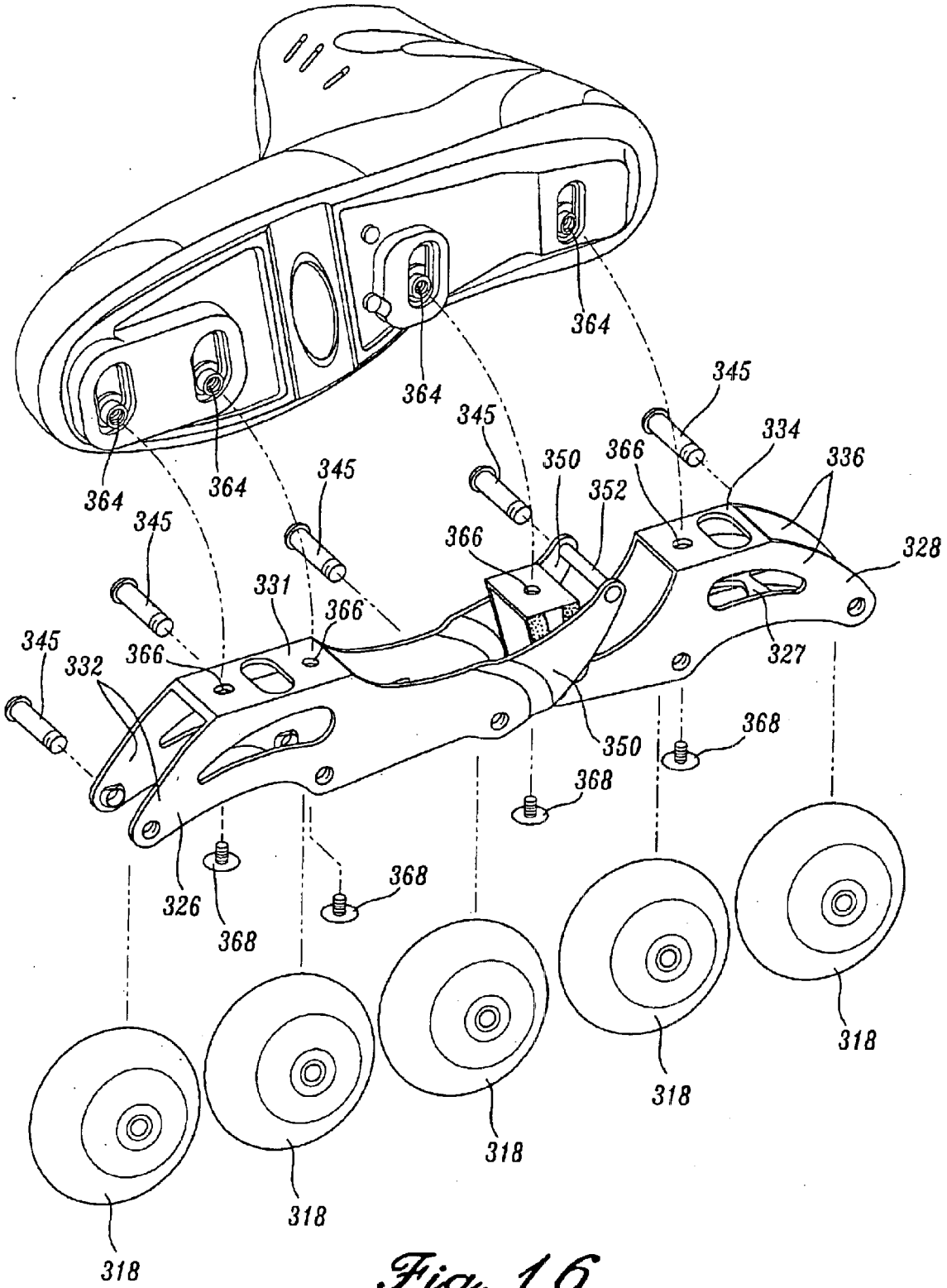
FIG. 16 provides an exploded pictorial view of the skate of FIG. 14.
Figure 17:
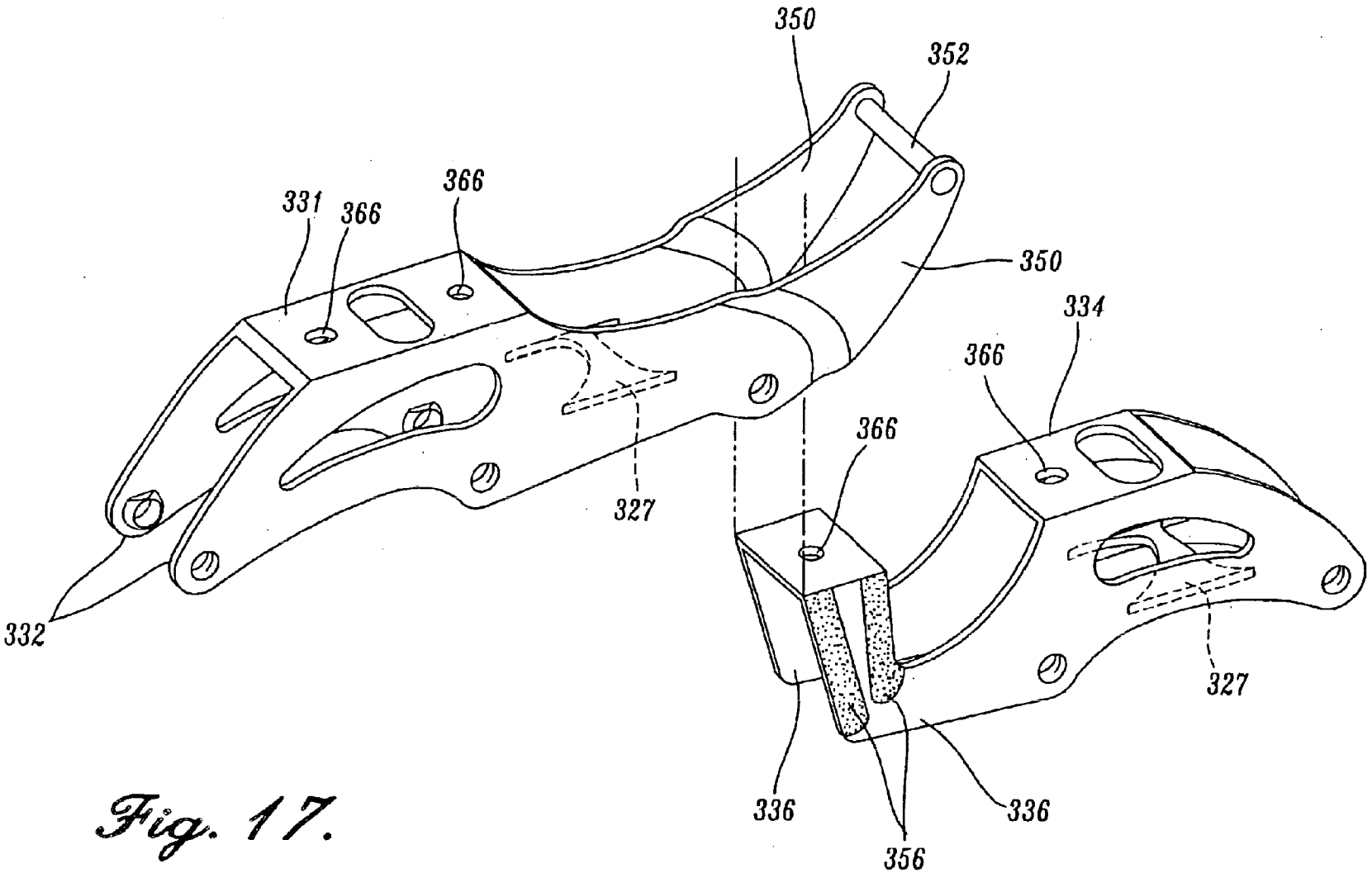
FIG. 17 provides an isometric view of the forward and rearward frame segments of the skate of FIG. 14.

Referring to FIGS. 14 and 16, the stabilizing pin 352, which connects the rearwardmost ends of flanges 350, is disposed rearwardly of the forwardmost point of connection of the rearward frame segment 328 by mounting bolt 368 through aperture 366 to the base 314. The stabilizing pin 352 is not connected to or engaged with the base 314 or to the rearward frame segment 328.

As in the prior embodiments, it should be apparent that the skate 310 could include two, rather than three, wheels in the forward frame segment 326; one wheel, rather than two, in the rearward frame segment 328; and the rearward frame segment overlapping the forward frame segment.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An in-line skate comprising:

a flexible upper;

a base attached to the upper, the base having a toe portion, a flexible metatarsal head portion extending rearwardly from the toe portion, and a heel portion extending rearwardly from the metatarsal head portion, the heel portion having a proximal end adjacent the flexible metatarsal head portion, wherein flexure of the metatarsal head portion allows the heel portion to move between a lower position and an upper position with respect to the toe portion;

a plurality of wheels;

a forward frame member having a pair of spaced sidewalls that rotatably supports at least two of the plurality of wheels, and a transverse section connecting the pair of sidewalls, the transverse section being attached to the toe portion of the base, wherein the forward frame member includes a support portion that extends rearwardly from the transverse section and underlies the proximal end of the heel portion of the base; and a rearward frame segment having a pair of spaced sidewalls that rotatably supports at least one of the plurality of wheels, and a transverse section connecting the pair of sidewalls, the transverse section being attached to the heel portion of the base;

wherein the heel portion of the base engages the support portion of the forward frame member when the base is in the lower position.

2. The in-line skate of claim 1, wherein the forward frame member is longitudinally aligned with the rearward frame member and overlaps a portion of the rearward frame member such that the forward frame member cannot rotate out of longitudinal alignment with the rearward frame member.

3. The in-line skate of claim 2, further comprising a low friction bearing surface defined on the overlapping portion of the rearward frame member.

4. The in-line skate of claim 1, wherein the support portion of the forward frame member includes a transverse stabilizing member that extends between the forward frame member sidewalls.

5. The in-line skate of claim 1, wherein the proximal end of the heel portion of the base further comprising at least one elastomeric bumper that is positioned to engage the support portion of the forward frame member.

6. The in-line skate of claim 1, wherein the forward frame member sidewalls comprise rearwardly disposed flanges extending from the transverse section of the forward frame member and slidably receiving a forward portion of the rearward frame member.

7. The in-line skate of claim 6, wherein the forward frame member rotatably supports three wheels and the rearward frame member rotatably supports one wheel.

8. The in-line skate of claim 6, wherein the forward frame member rotatably supports three wheels and the rearward frame member rotatably supports two wheels.

9. The in-line skate of claim 6, further comprising a biasing member that biases the heel region of the base towards the lower position.

10. The in-line skate of claim 9, wherein the base is constructed of a resilient material and integrally defines the biasing member.

11. The in-line skate of claim 9, wherein the biasing member comprises a strip of resilient material secured to a lower surface of the base.

12. The in-line skate of claim 11, wherein the biasing member is removable from the base.

13. A skate comprising:

a shoe portion for receiving a skater's foot;

a plurality of wheels;

a base fixedly attached to the shoe portion, the base including a rigid toe portion and a rigid a heel portion interconnected with a flexible metatarsal head portion such that the heel portion is movable between an upper position and a lower position with respect to the toe portion to permit elevation of the heel portion during skating; and a frame rotatably supporting the plurality of wheels, the frame having a forward segment secured to an underside of the toe portion of the base and including a pair of sidewalls having a back end that extends rearwardly to underlie the heel portion of the base, and a rearward segment secured to the heel portion of the base, wherein the forward frame segments include first and second stabilizing flanges that slidably overlap the rearward frame segments;

wherein the heel portion of the base contacts the back end of the forward segment sidewalls when the base is in the lower position.

14. The skate of claim 13, further comprising a low friction-bearing surface on the overlapped portion of the rearward frame segment.

15. The skate of claim 13, further comprising a transverse reinforcement disposed between the first and second stabilizing flanges.

16. The skate of claim 13, further comprising a locking element for selectively locking the forward and rearward frame segments to prevent flexure of the base.

17. The skate of claim 13, further comprising a biasing member coupled to the base to bias the heel portion of the base toward the lower position.

18. The skate of claim 13, wherein the metatarsal head portion of the base includes a stress concentrating contour that focuses flexure of the base at the metatarsal head portion.

19. The skate of claim 13, wherein at least one of the forward and rearward segments of the frame are mounted to the base for adjustable positioning in both the longitudinal and lateral directions.

* * * * *

UNITED STATES PATENT AND TRADEMARK OFFICE

CERTIFICATE OF CORRECTION

PATENT NO. : 6,921,093 B2
DATED : July 26, 2005
INVENTOR(S) : J.E. Svensson et al.

It is certified that error appears in the above-identified patent and that said Letters Patent is hereby corrected as shown below:

Column 20,
Line 43, “a rigid a heel” should read -- a rigid heel --.

Signed and Sealed this

Twenty-fifth Day of October, 2005

JON W. DUDAS
*Director of the United States Patent and Trademark Office*